US008042897B2

(12) United States Patent
Edelen et al.

(10) Patent No.: US 8,042,897 B2
(45) Date of Patent: Oct. 25, 2011

(54) METHOD FOR COMPENSATING SHIFT IN ON RESISTANCE OF TRANSISTOR OF PRINTHEAD

(75) Inventors: John Glenn Edelen, Versailles, KY (US); Prabuddha Jyotindra Mehta, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 467 days.

(21) Appl. No.: 12/166,396

(22) Filed: Jul. 2, 2008

(65) Prior Publication Data

US 2010/0002033 A1 Jan. 7, 2010

(51) Int. Cl.
*B41J 29/38* (2006.01)

(52) U.S. Cl. ..... 347/9; 347/10; 347/14

(58) Field of Classification Search ..... 347/9, 10, 347/14

See application file for complete search history.

(56) References Cited

U.S. PATENT DOCUMENTS

2005/0140707 A1* 6/2005 Imanaka et al. ..... 347/9
2005/0200657 A1* 9/2005 Nakazawa ..... 347/55

* cited by examiner

*Primary Examiner* — Matthew Luu
*Assistant Examiner* — Jannelle M Lebron

(57) ABSTRACT

Disclosed is a method for compensating a shift in an ON resistance of a transistor in a chip of a printhead of an inkjet printer. The method includes determining a value of a life indication parameter of the printhead and comparing the determined value of the life indication parameter of the printhead with at least one predetermined value of the life indication parameter. The at least one predetermined value of the life indication parameter of the printhead is stored in at least one of a memory of the inkjet printer and a memory of the chip of the printhead. Thereafter, a gate voltage input to the transistor is modified based on a difference between the determined value of the life indication parameter and the at least one predetermined value of the life indication parameter of the printhead for compensating the shift in the ON resistance of the transistor.

2 Claims, 20 Drawing Sheets

METHOD FOR COMPENSATING SHIFT IN ON RESISTANCE OF TRANSISTOR OF PRINTHEAD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to inkjet printheads, and more particularly to a method for compensating shift in ON resistance of transistors of the inkjet printheads.

2. Description of the Related Art

Inkjet printers print data on a physical print medium, such as a paper sheet, a transparency and the like, by discharging ink droplets thereon. An inkjet printer includes one or more ink tank for storing ink therein, and a fluid ejection head (herein after referred to as printhead) coupled to the ink tank for discharging ink droplets therefrom. The ink tank may contain one or more ink reservoirs for storing the ink therein. The one or more ink reservoirs may contain colored ink or mono-chrome ink.

The printhead may be disposed on an ink tank body, thereby configuring a print cartridge. When the ink contained in the one or more ink tanks (herein after referred to as the ink tanks) is exhausted, the print cartridge may be replaced with a new print cartridge. Such a printhead configured on a replaceable print cartridge is referred to as a "disposable printhead." Alternatively, the printhead may be permanently disposed on the printer, and in such an instance only the ink tank is replaceable. Such a non replaceable printhead is referred to as a "permanent printhead." However, irrespective of the type of printhead being used in the inkjet printer, the printhead is always in operative coupling with the ink tanks for receiving the ink therefrom.

Referring to FIG. 1, a cross sectional view of a prior art printhead 100 is illustrated. Printhead 100 includes a printhead chip 105 having a semiconductor substrate 110 (herein after referred to as substrate 110) and a plurality of heaters, such as a heater 115, bonded to substrate 110. Substrate 110 is operatively coupled to an ink tank (not shown), and includes a plurality of openings, for example an opening 120, for supplying ink therethrough to a plurality of bubble chambers, such as a bubble chamber 125, configured in printhead 100. Bubble chamber 125 acts as a temporary ink tank for receiving the ink from the ink tanks and storing the same therewithin. Moreover, printhead chip 105 includes a memory module (not shown) adapted to store parameters associated with the inkjet printer, such as a value of a number of pages printed by the printhead, a value of a number of pages printed by an ink tank operatively coupled to the printhead, an identification number of the ink tank operatively coupled to the printhead, and the like. However, it will be evident to a person skilled in the art that the parameters may also be stored in a memory associated with the inkjet printer.

The printhead 100 further includes a nozzle plate 130 having a plurality of nozzles, for example, a nozzle 135 for dispensing ink therefrom. Nozzle plate 130 may be bonded to substrate 110 by any conventional technique, for example, by forming an adhesive layer therebetween. More specifically, nozzle plate 130 is bonded to substrate 110, such that the plurality of heaters is disposed beneath the plurality of nozzles of nozzle plate 130. For example, heater 115 may be disposed beneath nozzle 135. Moreover, substrate 110 bonded to nozzle plate 130 configures a plurality of bubble chambers between the plurality of heaters and corresponding nozzles, and a channel 140 for supplying the ink therethrough to the plurality of bubble chambers. More particularly, the plurality of bubble chambers are open spaces above each of the heaters of the plurality of heaters, which are adapted to receive the ink from the one or more ink tanks. As shown in FIG. 1, bubble chamber 125 is configured over heater 115.

In operation, the ink supplied by the ink tank flows into bubble chamber 125 through opening 120 and channel 140. Based on an image to be printed on the print medium, the printer selectively activates some of the heaters of the plurality of heaters. The activated heaters (for example, heater 115) in turn heat the ink received in the corresponding bubble chambers (for example, bubble chamber 125). As a result, an expanding bubble is formed within the ink. The expanding bubble expels the ink through the nozzles corresponding to the activated heaters, onto the print medium, thereby forming small dots of ink on the print medium. Accordingly, a selective activation of the heaters of the printhead may be utilized to print required data on the print medium.

The selective activation of the plurality of the heaters may be controlled by means of a control circuit. More specifically, the control circuit is operatively coupled to the plurality of heaters for controlling an activation of the plurality of heaters. The control circuit includes a plurality of transistors. Examples of the plurality of transistors of may include, but is not limited to a Power Field Effect Transistor (FET). The plurality of transistors is configured on printhead chip 105.

During operation of the plurality of heaters, individual heaters, such as heater 115, may be activated for heating the ink contained in a corresponding bubble chamber, such as bubble chamber 125. The firing of individual heaters may be controlled by corresponding transistors of the control circuit. With reference to FIG. 2A, a control circuit 200 for controlling activation of a heater, such as a heater 205 is illustrated. Heater 205 is similar to heater 115, and is connected to a power source, for example, a battery (represented as '+V').

Control circuit 200 may be disposed on a conventional printhead chip (not shown), similar to printhead chip 105. Moreover, control circuit 200 includes an FET 210 operatively coupled to heater 205. More specifically, a drain terminal 210*a* of FET 210 is electrically coupled to heater 205, while a source terminal 210*b* of FET 210 is electrically coupled to a ground terminal 215. Moreover, FET 210 includes a gate terminal 210*c* such that on applying an appropriate gate voltage at gate terminal 210*c*, the operation of FET 210 may be controlled. More specifically, FET 210 may be driven to a conduction stage or out of conduction stage by applying the appropriate gate voltage.

Control circuit 200 further includes a gate drive circuit 220 adapted to control the gate voltage input to gate terminal 210*c* of FET 210. Accordingly, control circuit 200 is adapted to drive FET 210 to the conduction stage or out of the conduction stage. Preferably, gate drive circuit 220 may generate a plurality of electrical pulses, hereinafter referred to as "fire instructions", which is supplied to gate terminal 210*c* for driving FET 210 to conduction. Once FET 210 is driven to the conduction stage, a conducting path is configured between the power source "+V" and ground terminal 215, thereby causing a current to flow from the power source "+V" to ground terminal 215 through heater 205 and FET 210. The current flowing through heater 205 effectuates heating thereof, which is utilized to heat the ink contained in a corresponding bubble chamber of heater 205.

Practically, it has been observed that efficiency of the heater and FET arrangement, such as heater 205 and FET 210, of the printhead reduces over a life span of the printhead. More specifically, a heating effect produced by the heaters may reduce during continued usage of the printhead, thereby deteriorating quality of images printed by the printhead. The reduction in the heating effect of the heaters, such as heater 205, may be attributed to a shift in a conduction state resistance or commonly referred to as ON resistance (hereinafter referred to as "$R_{ON}$") of the corresponding transistors, such as FET 210, in a chip of the printhead. More specifically, the $R_{ON}$ of the FETs increases over the life span of the printhead, thereby increasing a power loss in the transistors, such as FET 210, and consequently decreasing the heating effect produced by the heaters, such as heater 205.

Various experimental results have shown that high operating voltages of the heaters and high firing frequencies of the printheads results in an increase in a value of the $R_{ON}$ of the transistors in the chip of the printhead. With reference to FIG. 2B, a curve 250 depicting an increase in the value of $R_{ON}$ of a transistor, for example FET 210, in a chip of a printhead over a life span of a printhead is illustrated. The life span of the printhead is hereinafter referred to as "life of the printhead". As evident from a curve 250 (FIG. 2B), the value of $R_{ON}$ of the transistor increases over the life of the printhead till a predetermined value of life of printhead (marked as 252 in FIG. 2B). After this value of life of printhead, the value of $R_{ON}$ of the transistor reaches a saturation value and remains substantially constant with increase in value of life of printhead.

Generally, an increase in the value of $R_{ON}$ of transistors in a chip of a printhead of an ink-jet printer has an adverse effect on a printing efficiency of the printhead, thereby deteriorating a print quality thereof. More specifically, the increase in the value of $R_{ON}$ of the transistors reduces the heating effect produced by the heaters of the printhead. Consequently, ink bubbles formed in the bubble chambers of the nozzle plate, due to the insufficient heating effect produced by the heaters, may not be uniform, thereby causing formation of poor quality ink dots on a printing medium. Accordingly, the printing efficiency of the printhead reduces over its life span.

Accordingly, there persists a need for a printhead of a printer, which overcomes the drawbacks and limitations of prior art printheads. Further, there persists a need for a method for improving a printing efficiency of a printhead over a life span thereof. More specifically, there persists a need for a method for compensating the increase in an ON resistance ($R_{ON}$) of transistors in a chip of a printhead over a life of the printhead.

SUMMARY OF THE INVENTION

In view of the foregoing disadvantages inherent in the prior art, the general purpose of the present disclosure is to provide a method for compensating a shift in an ON resistance ($R_{ON}$) of a transistor in a chip of a printhead of an inkjet printer by including all the advantages of the prior art, and overcoming the drawbacks inherent therein.

Accordingly, in one aspect, the present disclosure provides a method for compensating a shift in an $R_{ON}$ of a transistor in a chip of a printhead (herein after called the printhead chip) of an inkjet printer. The method includes determining a value of a life indication parameter of the printhead. The method further includes comparing the determined value of the life indication parameter of the printhead with at least one predetermined value of the life indication parameter of the printhead. Moreover, the method includes modifying a gate voltage input to the transistor based on a difference between the determined value of the life indication parameter and the at least one predetermined value of the life indication parameter of the printhead for compensating the shift in the ON resistance of the transistor. Preferably, the at least one predetermined value of the life indication parameter of the printhead is stored in at least one of a memory of the inkjet printer and a memory of the chip of the printhead.

In another aspect, the present disclosure provides a method for compensating a shift in an ON resistance of a transistor in a printhead chip of an inkjet printer. The method includes determining a value of an identification number of at least one ink tank operatively coupled to the printhead. The method further includes comparing the determined value of the identification number of the at least one ink tank with at least one predetermined value of the identification number of the at least one ink tank. Furthermore, the method includes determining a value of a number of pages printed by the printhead upon the determined value of the identification number of the at least one ink tank being different from the at least one predetermined value of the identification number of the at least one ink tank. Moreover, the method includes comparing the determined value of the number of pages printed by the printhead with at least one predetermined value of the number of pages for the printhead. Thereafter, the method includes modifying a gate voltage input to the transistor based on the difference between the determined value of the number of pages printed by the printhead and the at least one predetermined value of the number of pages for the printhead for compensating the shift in the ON resistance of the transistor.

In yet another aspect, the present disclosure provides a method for compensating a shift in an ON resistance of a transistor in a printhead chip of an inkjet printer. In the said aspect, the method includes determining a value of an identification number of at least one ink tank operatively coupled to the printhead. The method further includes comparing the determined value of the identification number of the at least one ink tank with at least one predetermined value of the identification number of the at least one ink tank. Furthermore, the method includes determining a value of a number of fire instructions received by the transistor of the printhead when the determined value of the identification number of the at least one ink tank is different from the at least one predetermined value of the identification number of the at least one ink tank. Moreover, the method includes comparing the determined value of the number of fire instructions with at least one predetermined value of the number of fire instructions. Thereafter, the method includes modifying a gate voltage input to the transistor based on the difference between the determined value of the number of fire instructions and the at least one predetermined value of the number of fire instructions for compensating the shift in the ON resistance of the transistor.

In yet another aspect, the present disclosure provides a method for determining the value of a life indication parameter of a printhead based on a number of pages printed by the printhead.

In yet another aspect, the present disclosure provides a method for determining the value of a life indication parameter of a printhead based on a number of pages printed by at least one ink-tank that is operatively coupled to the printhead.

In still another aspect, the present disclosure provides a method for determining the value of a life indication parameter of a printhead based on an identification number of at least one ink tank operatively coupled to the printhead.

In still another aspect, the present disclosure provides a method for determining the value of a life indication parameter of a printhead based on a number of fire instructions received by the transistor of the printhead.

BRIEF DESCRIPTION OF THE DRAWINGS

The above-mentioned and other features and advantages of the invention of the present disclosure, and the manner of attaining them, will become more apparent and the invention will be better understood by reference to the following description of embodiments of the invention taken in conjunction with the accompanying drawings, wherein.

DETAILED DESCRIPTION

Figure 1:
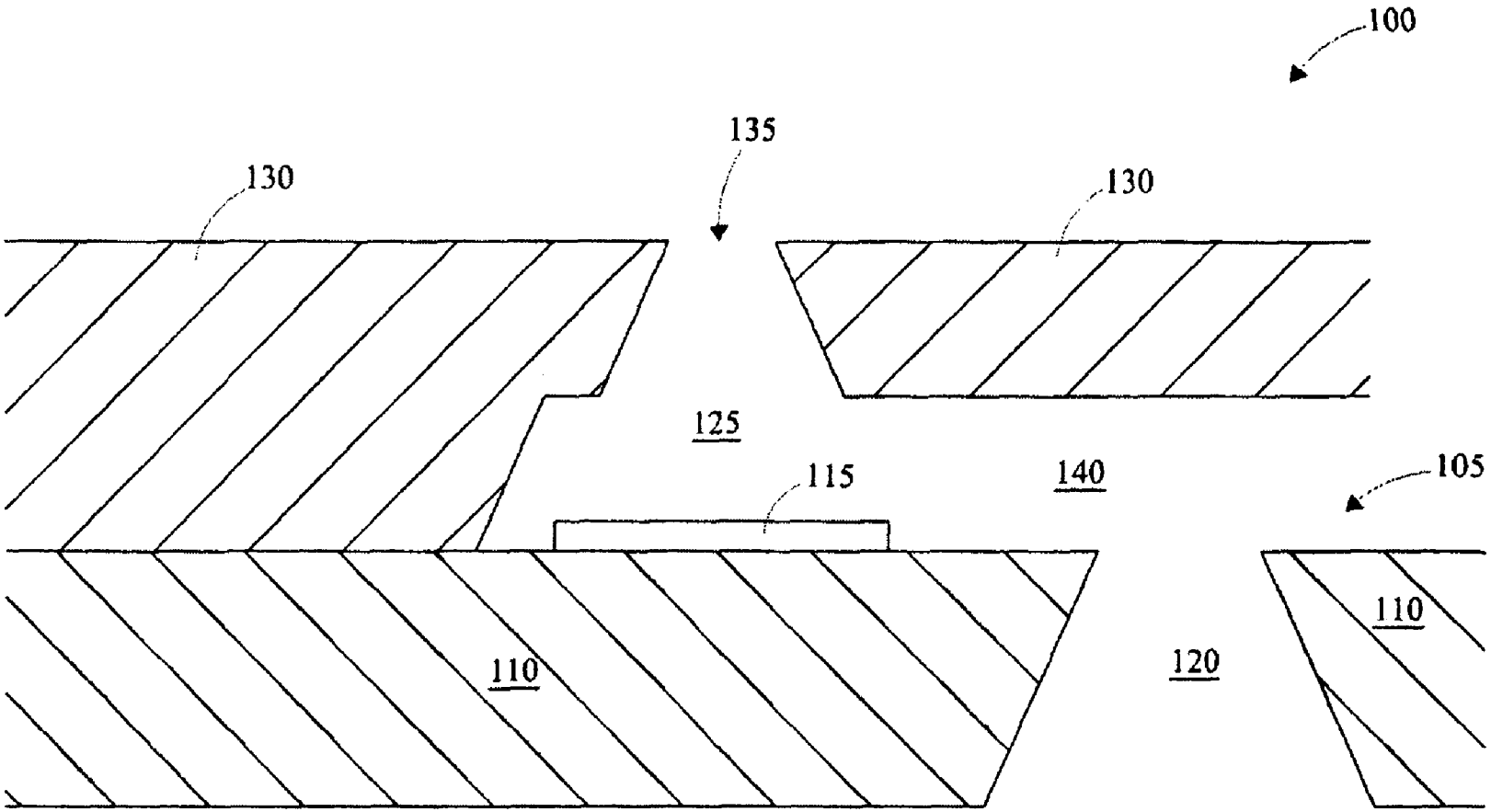
Figure 1 (PRIOR ART)
FIG. 1 illustrates a cross sectional view of a prior art printhead of an ink-jet printer.
Figure 2A:
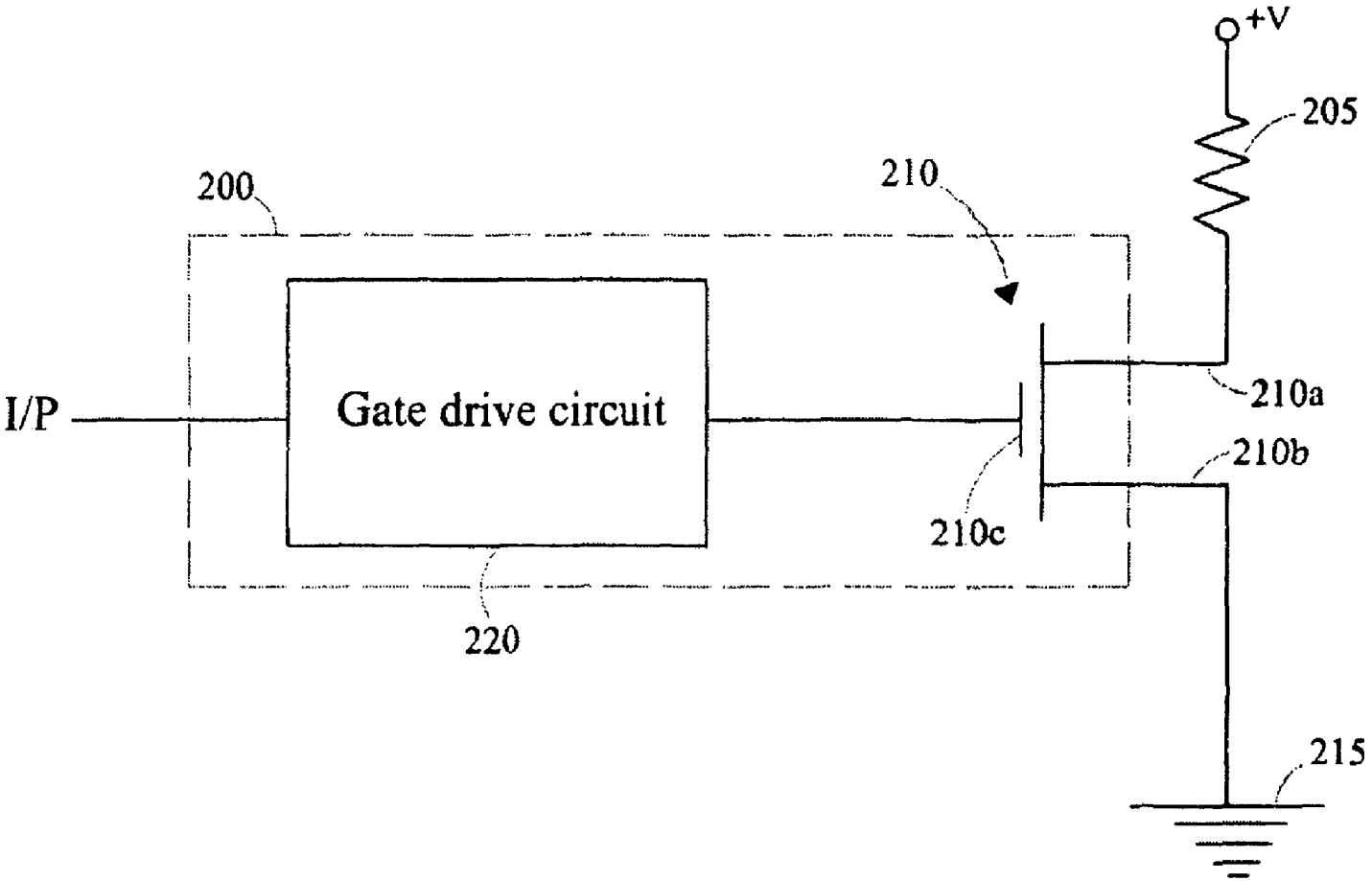
FIG. 2A illustrates a control circuit for controlling operation of a heater utilized in a conventional printhead of an ink-jet printer.
Figure 2B:
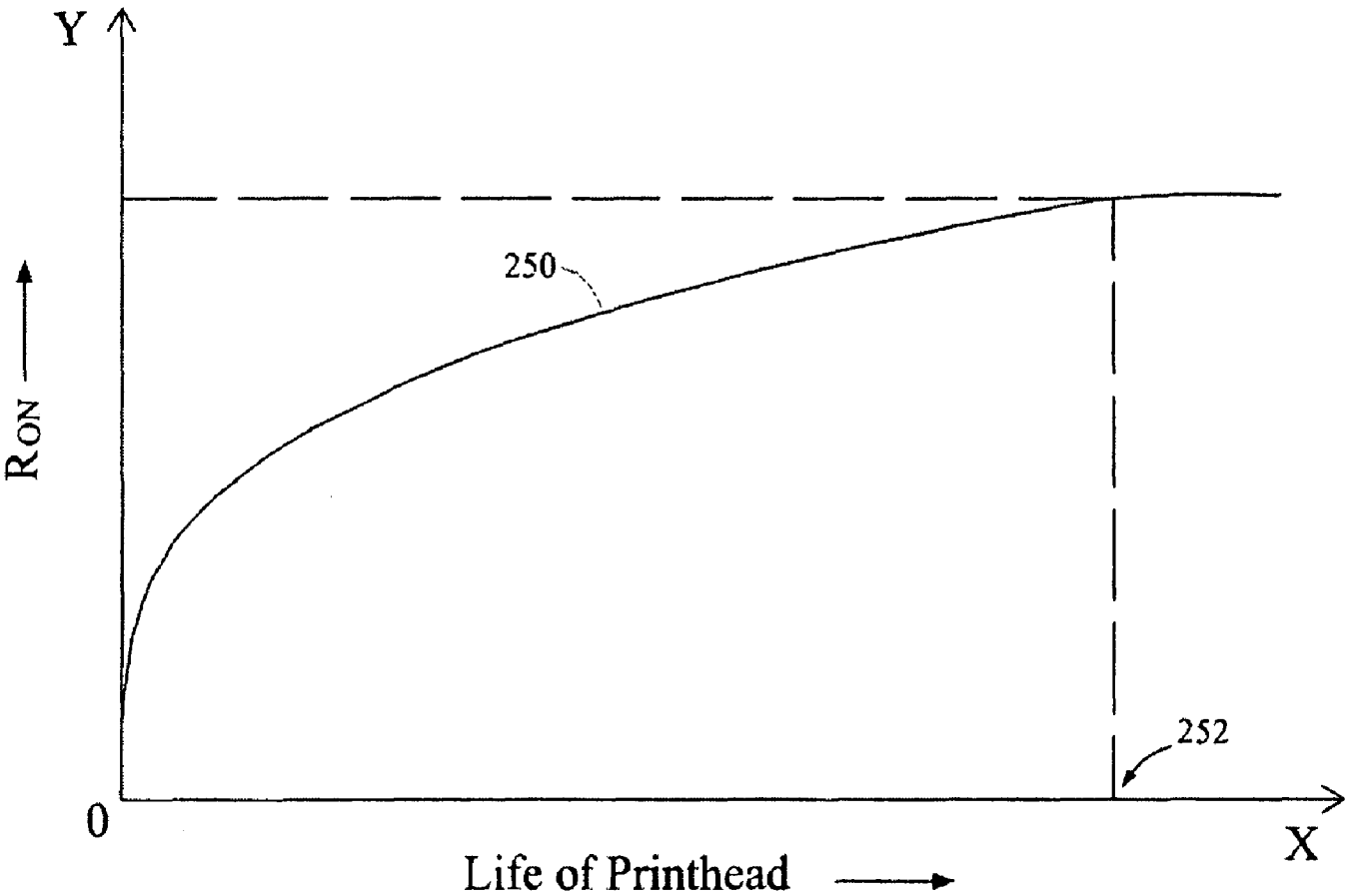
FIG. 2B illustrates a graph representing an increase in $R_{ON}$ of a transistor in a printhead chip over a life span of the printhead.

It is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the disclosure include both hardware and electronic components or modules that, for purposes of discussion, may be illustrated and described as if the majority of the components were implemented solely in hardware.

However, one of ordinary skill in the art, and based on a reading of this detailed description, would recognize that, in at least one embodiment, the methods disclosed in the disclosure may be implemented in software. As such, it should be noted that a plurality of hardware and software-based devices, as well as a plurality of different structural components may be utilized to implement the disclosure. Furthermore, and as described in subsequent paragraphs, the specific configurations illustrated in the drawings are intended to exemplify embodiments of the disclosure and that other alternative configurations are possible.

Accordingly, the present disclosure provides various embodiments of a method for compensating a shift in $R_{ON}$ of a transistor, such as FET 210, in a printhead chip of an inkjet printer. It will be evident to a person skilled in the art that the term "transistor" encompasses a wide variety of transistor devices, such as a Bipolar Junction Transistor (BJT), FET and the like, however for sake of brevity the methods described in the present disclosure have been defined with respect to FET only. Further, without limiting the scope of the present disclosure, the various embodiments of the method are described with respect to a single transistor of the plurality of transistors and a single heater of the plurality of heaters utilized in the printhead chip. It will be evident to a person skilled in the art that the said embodiments are also relevant when more than one transistor and one heater are considered.

Further, the term "printhead", as used hereunder, has been used to encompass both a disposable and a permanent type of printheads. Accordingly, the methods as described herein may be utilized for compensating a shift in $R_{ON}$ of both the permanent printhead and the disposable printhead.

Furthermore, the term "ink tank", as used hereunder, encompasses both an on-carrier ink tank and an off-carrier ink tank. The on-carrier ink tank include ink tank containers configured on the printhead, such that the ink tank containers move across the print medium for printing operations thereon. The off-carrier ink tank is generally disposed at a remote location away from the printhead within a printer such that a tubing may be utilized to transfer the ink contained in the off-carrier ink tank to the printhead. Upon exhaustion of the ink contained in the off-carrier ink tank, the off-carrier ink tank may be replaced, thereby precluding a need for replacement of the printhead. The on-carrier ink tank and the off-carrier ink tank may be used along with a permanent or a semi-permanent type printhead. Moreover, the ink tanks may include a single reservoir or a plurality of reservoirs therewithin for storing inks of different colors within the same ink tank.

The present disclosure contemplates increasing a gate voltage input to a gate terminal of the transistor of the printhead for compensating the shift in the $R_{ON}$ of the transistor in the printhead chip. The effect of increasing the gate voltage input to a transistor in a printhead chip may be explained by referring to FIG. 3.

Figure 3:
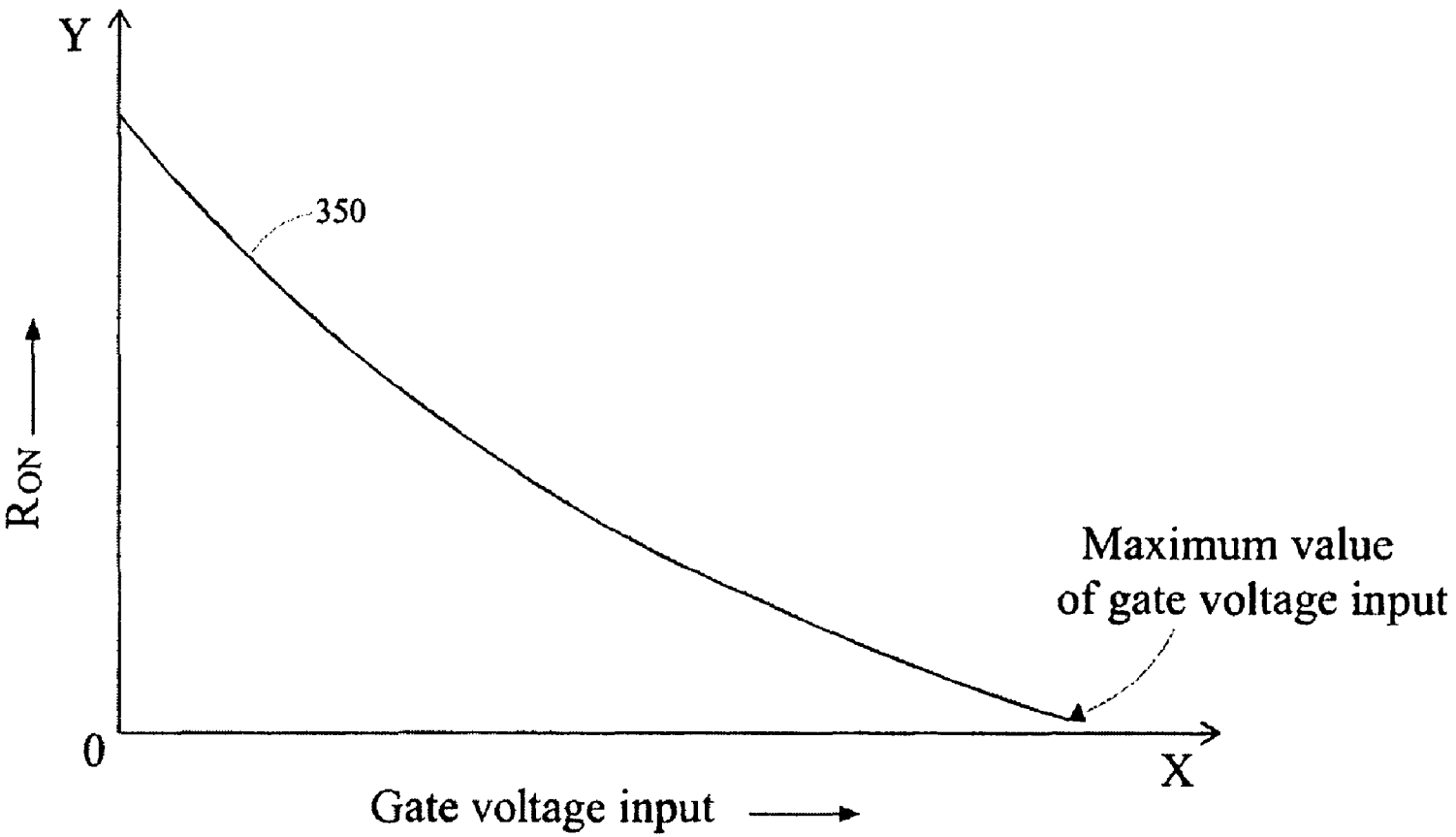
FIG. 3 illustrates a graph representing a variation in $R_{ON}$ of a transistor in a printhead chip with respect to a variation in a gate voltage input to the transistor.

FIG. 3 illustrates a graph depicting a curve 350 representing a variation in the $R_{ON}$ of a transistor of a printhead chip with respect to a variation in a gate voltage input to the transistor. The X-axis of the graph represents the gate voltage input to the transistor, while the Y-axis of the graph represents the $R_{ON}$ of the transistor. As evident from the curve 350, the $R_{ON}$ of the transistor decreases with the increase in the gate voltage input to the transistor. For example, an exemplary conventional printhead may incorporate a gate voltage input of about 5V to the transistor and an $R_{ON}$ of about 25 Ohms. After a prolonged usage of the printhead, the $R_{ON}$ of the transistor may increase from an original value of 25 Ohms to, for example, 30 ohms. This increase in the $R_{ON}$ of the transistor may be compensated by increasing the gate voltage input to the transistor to, for example, 6.5V from 5V. More specifically, during the life of the printhead, the gate voltage input to the transistor may be incremented from 5V to 6.5V in steps of say, 0.1 Volts. Further, as shown in FIG. 3, there exists a maximum value of the gate voltage input that may be applied to the transistor. More specifically, the maximum value of the gate voltage input is limited by the saturation value of the $R_{ON}$ of the transistor. With reference to FIG. 3, the maximum value of the gate voltage input is represented.

In view of the foregoing, a method for compensating a shift in $R_{ON}$ of a transistor in a printhead chip of an inkjet printer is disclosed herein, in accordance with an embodiment of the present disclosure. The method includes determining a value of a life indication parameter of the printhead. Thereafter, the determined value of the life indication parameter of the printhead is compared with at least one predetermined value of the life indication parameter of the printhead. Subsequently, based on a difference between the determined value of the life indication parameter and the at least one predetermined value of the life indication parameter of the printhead, the gate voltage input to the transistor may be modified, thereby compensating the shift in the ON resistance of the transistor.

The life indication parameter of the printhead may be utilized for estimating a proportion of a total expected life of the printhead that has already been utilized. In one embodiment of the present disclosure, the life indication parameter is a number of pages printed by the printhead. In another embodiment of the present disclosure, the life indication parameter is a number of pages printed by at least one ink tank operatively coupled to the printhead. In yet another embodiment of the present disclosure, the life indication parameter is an identification number of at least one ink tank operatively coupled to the printhead. In still another embodiment of the present disclosure, the life indication parameter is a number of fire instructions received by the transistor in the printhead chip.

Figure 4:
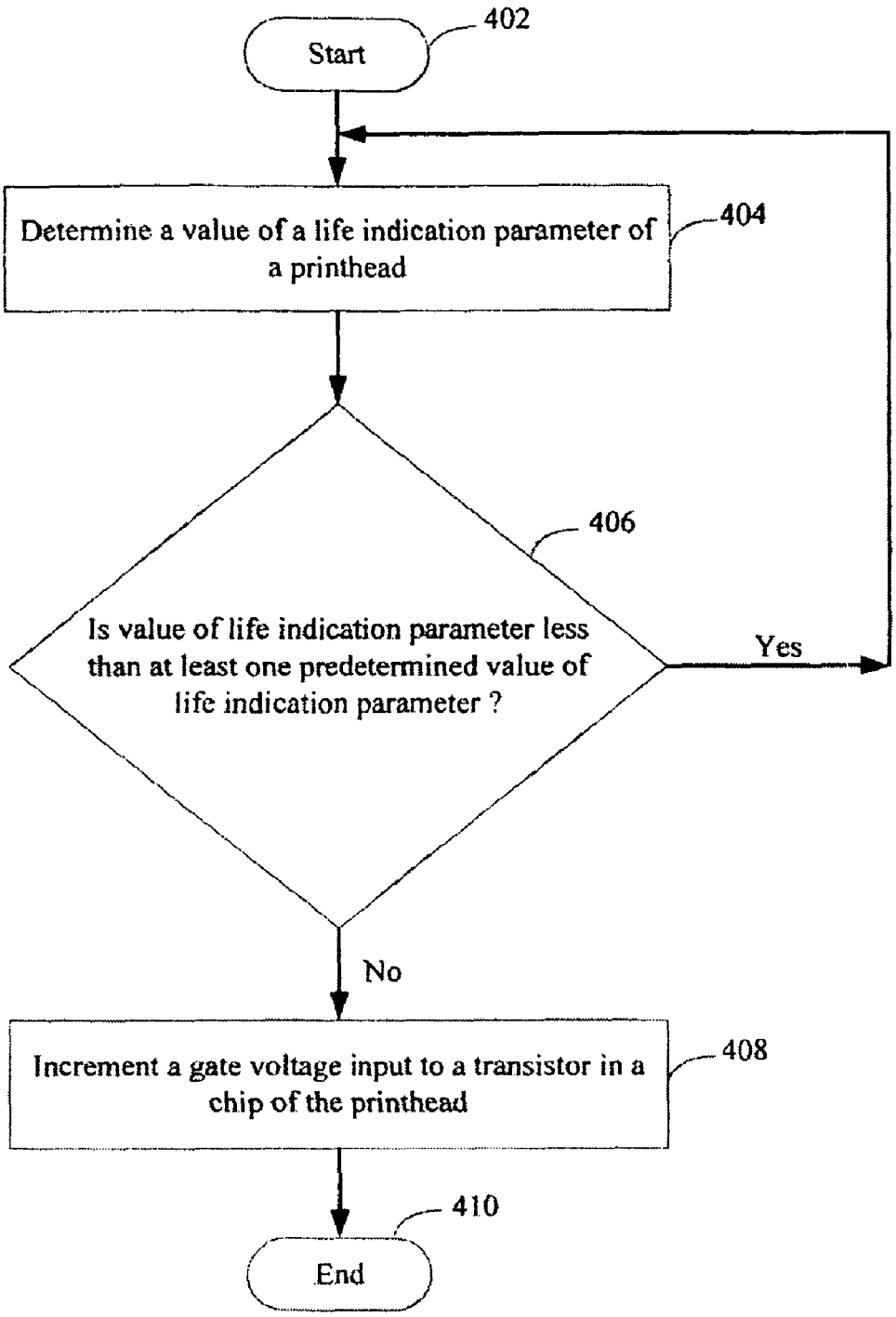
FIG. 4 illustrates a flow diagram representing a method for compensating a shift in ON resistance of a transistor in a printhead chip of an inkjet printer, in accordance with an exemplary embodiment of the present disclosure.

With reference to FIG. 4, a flow diagram representing a method for compensating a shift in $R_{ON}$ of a transistor in a chip of a printhead is illustrated. The method initiates at 402. A value of a life indication parameter of the printhead is determined at 404. In the present embodiment, the life indication parameter is at least one of a number of pages printed by the printhead, a number of pages printed by at least one ink tank operatively coupled to the printhead, and a number of fire instructions received by the transistor in the printhead chip. The embodiment describing the method with identification number of at least one ink tank as the life indication parameter may be explained further in conjunction with FIG. 8.

Upon determination of the life indication parameter of the printhead, it is determined whether the determined value of the life indication parameter is less than at least one predetermined value of the life indication parameter of the printhead, at 406. Preferably, the at least one predetermined value of the life indication parameter of the printhead is stored in at least one of a memory of the inkjet printer (herein after referred to as printer memory) and a memory of the chip of the printhead (herein after referred to as printhead chip memory).

When it is determined at 406 that the determined value of the life indication parameter is less than the at least one predetermined value of the life indication parameter of the printhead, the gate voltage input to the transistor may be incremented at 408. It will be apparent to a person skilled in the art that the incremented value of the gate voltage input is less than a maximum value of the gate voltage input. The gate voltage input to the transistor may be incremented multiple number of times during the life of the printhead. More specifically, the gate voltage input to the transistor may be incremented until the end of life of the printhead is reached. The end of life of the printhead may be determined based on the value of the gate voltage input or the life indication parameter of the printhead. The determination of the end of life of the printhead based on the value of the gate voltage input or the life indication parameter of the printhead may be explained further in conjunction with FIGS. 4A and 4B. Upon achieving the end of life of the printhead, the method terminates at 410.

Figure 4A:
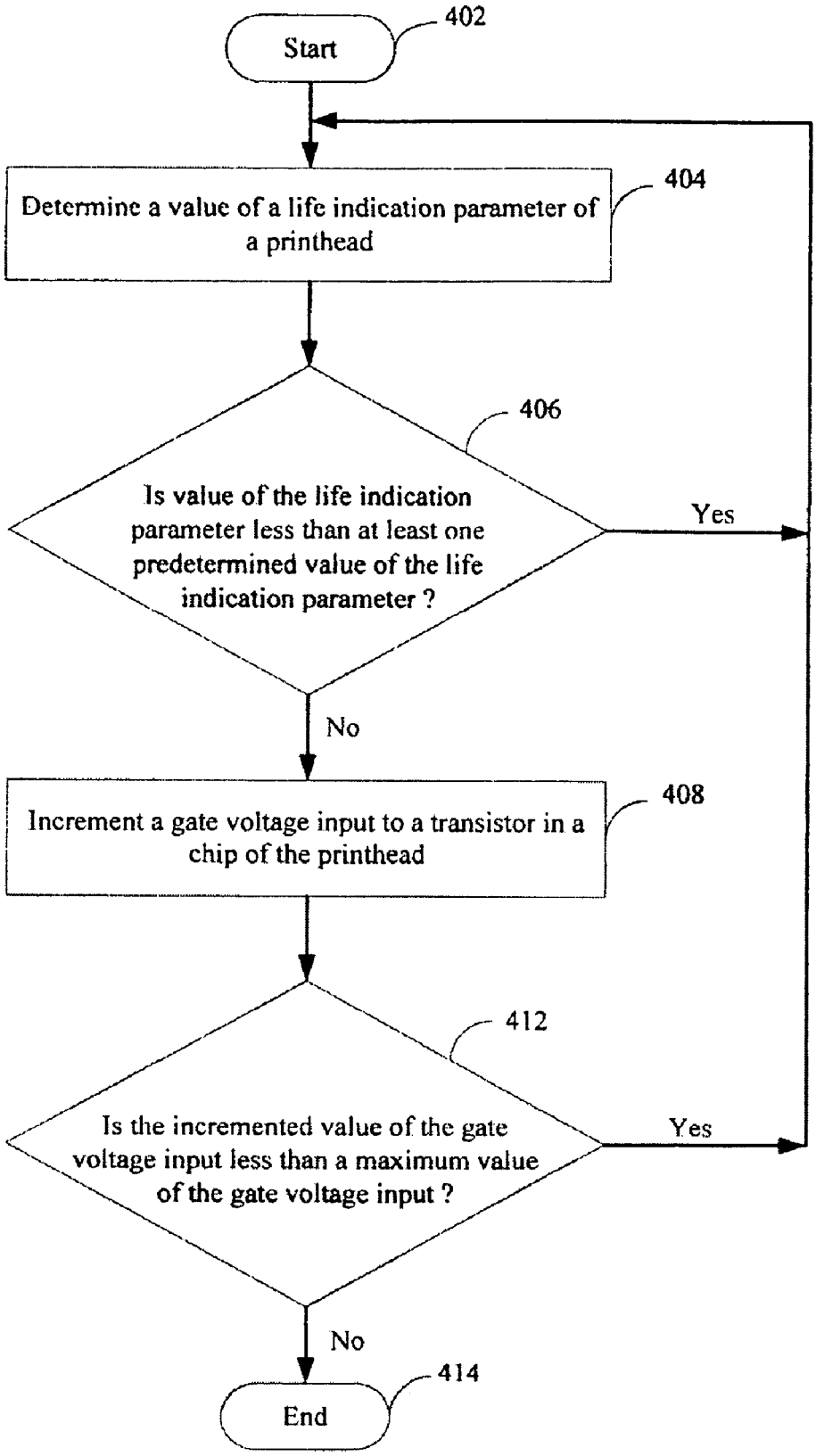
FIG. 4A illustrates a flow diagram representing a method for compensating a shift in ON resistance of a transistor in a printhead chip of an inkjet printer, in accordance with another exemplary embodiment of the present disclosure.

With reference to FIG. 4A, a flow diagram representing a method for compensating a shift in ON resistance of a transistor in a printhead chip of an inkjet printer, in accordance with another exemplary embodiment of the present disclosure is illustrated. The method explained with reference to flow diagram of FIG. 4A is same as flow diagram illustrated in FIG. 4, except that FIG. 4A includes an additional step for determination of end of life of the printhead. Moreover, same steps 402, 404, 406 408 as those shown FIG. 4 are designated by like reference numerals, and an explanation thereof will thus be omitted.

Referring to FIG. 4A, the determination of the end of life of the printhead may be carried out by comparing the incremented value of gate voltage input to the transistor, at 408, with the maximum value of the gate voltage input to the transistor at 412. Upon determination of the incremented value of the gate voltage input to be less than the maximum value of the gate voltage input, the life indication parameter is again determined at 404. However, when it is determined at 412 that the incremented value of the gate voltage input is greater than or equal to the maximum value of the gate voltage input, the end of life of the printhead may be implied. Thereafter, the method terminates at 414.

Figure 4B:
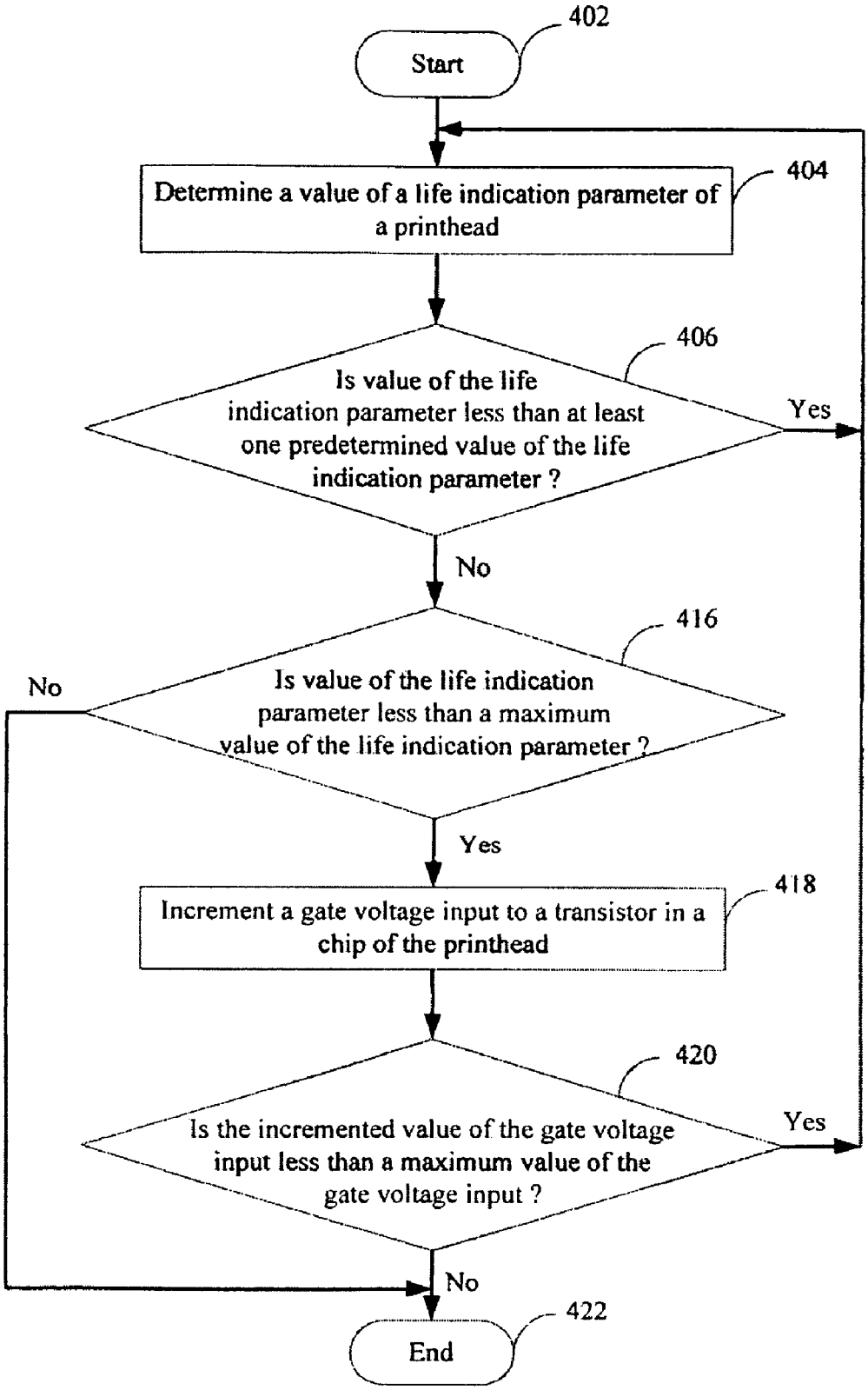
FIG. 4B illustrates a flow diagram representing a method for compensating a shift in ON resistance of a transistor in a printhead chip of an inkjet printer, in accordance with yet another exemplary embodiment of the present disclosure.

With reference to FIG. 4B, a flow diagram representing a method for compensating a shift in ON resistance of a transistor in a printhead chip of an inkjet printer, in accordance with yet another exemplary embodiment of the present disclosure is illustrated. The method explained with reference to flow diagram of FIG. 4B is same as flow diagram illustrated in FIG. 4, except that FIG. 4B includes additional steps for determination of end of life of the printhead. Moreover, same steps 402, 404, 406 as those shown FIG. 4 are designated by like reference numerals, and an explanation thereof will thus be omitted.

Referring to FIG. 4B, the determination of the end of life of the printhead may be carried out by comparing the value of the life indication parameter determined at 404 with a maximum value of the life indication parameter at 416. The maximum value of the life indication parameter may be selected based upon operating parameters of the printhead, such as, desired operating efficiency of the printhead, operating parameters of the printhead circuitry, and the like.

When it is determined at 416 that the determined value of the life indication parameter is less than the maximum value of the life indication parameter, the gate voltage input is incremented at 418. Thereafter, the incremented value of the gate voltage input is compared with the maximum value of the gate voltage input at 420. Upon determining the incremented value of the gate voltage input to be less than the maximum value of the gate voltage input, the life indication parameter is again determined at 404. However, when it is determined at 420 that the incremented value of the gate voltage input is greater than or equal to the maximum value of the gate voltage input, the end of life of the printhead may be implied. Thereafter, the method terminates at 422.

When it is determined at 416 that the determined value of the life indication parameter is greater than or equal to the maximum value of the life indication parameter, the method terminates at 422.

Various embodiments of the present disclosure utilizing the various aforementioned life indication parameters for compensation of $R_{ON}$ of the transistor of the printhead may be individually explained further in conjunction with FIGS. 5A through 8.

Figure 5A:
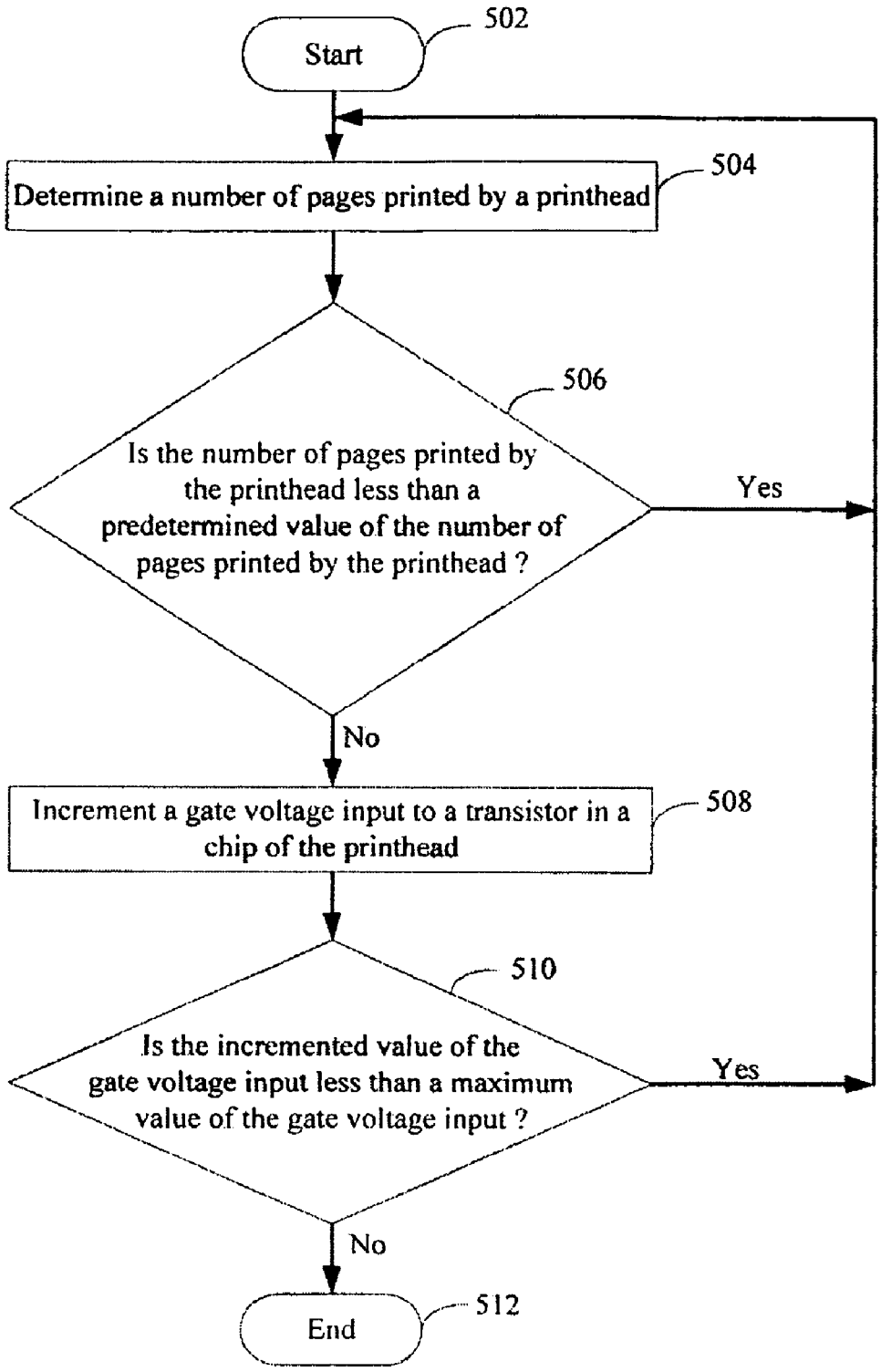
FIG. 5A illustrates a flow diagram representing a method for compensating a shift in ON resistance of a transistor in a printhead chip of an inkjet printer, in accordance with still another exemplary embodiment of the present disclosure.
Figure 5B:
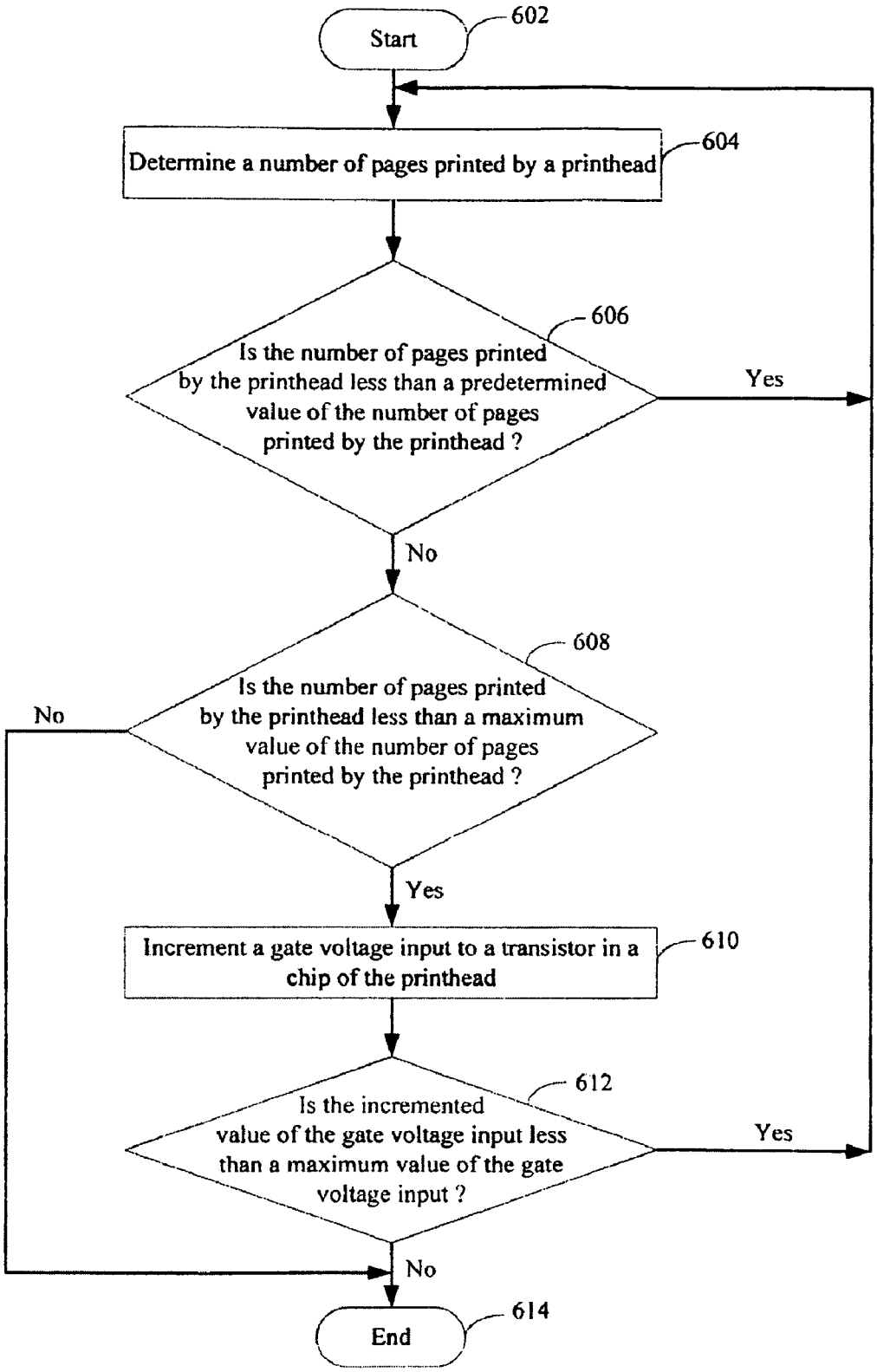
FIG. 5B illustrates a flow diagram representing a method for compensating a shift in ON resistance of a transistor in a printhead chip of an inkjet printer, in accordance with still another exemplary embodiment of the present disclosure.

FIGS. 5A and 5B illustrate flow diagrams, each depicting a method for compensating a shift in $R_{ON}$ of a transistor in a printhead chip of an inkjet printer in accordance with still another embodiment of the present disclosure. In said figures, the shift in the $R_{ON}$ of the transistor is compensated by utilizing information of the number of pages printed by the printhead. More specifically, in the present embodiment, the life indication parameter is the number of pages printed by the printhead (herein after referred to as the 'printhead page count').

The compensation of the shift in the $R_{ON}$ of the transistor is carried out over the life of the printhead by incrementing the gate voltage input to the transistor a multiple times over the life of the printhead until the end of life of the printhead is reached. More particularly, FIG. 5A illustrates determination of the end of life of the printhead based upon comparison of the incremented value of gate voltage input to the transistor with the maximum value of the gate voltage input to the transistor. Further, FIG. 5B illustrates determination of the end of life of the printhead based upon the comparison of the determined value of the printhead page count, with a maximum value of the printhead page count.

Referring to FIG. 5A, the method for compensating the shift in the $R_{ON}$ of the transistor of the printhead based on the number of pages printed by the printhead is initiated at 502. A value of printhead page count may be determined at 504. The determined value of the printhead page count may be stored in at least one of the printhead chip memory and the printer memory. At 506, it is determined whether the determined value of the printhead page count at 504 is less than a predetermined value of the printhead page count. Further, the predetermined value of the printhead page count may be stored in at least one of the printhead chip memory and the printer memory. The predetermined value of the printhead page count may include a plurality of values depending upon a desired performance of the printhead. Accordingly, the determined value of printhead page count may be compared with any one value of the plurality of values of the printhead page count for achieving the desired performance of the printhead. However, for sake of brevity, the method will be explained with respect to one predetermined value of the printhead page count only.

When it is determined at 506 that the determined value of the print head page count is less than the predetermined value of the printhead page count, the value of the printhead page count is again determined at 504. However, when it is determined at 506 that the determined value of the printhead page count is not less than the predetermined value of the printhead page count, a gate voltage input to the transistor in the printhead chip is incremented by a predetermined value at 508. For example, the printer memory or the printhead chip memory may store a predetermined value of the printhead page count as 500 pages. During operation of the printer, when the page count of the printhead is determined to be 500 pages or greater than 500 pages, the value of the gate voltage input may be incremented by, for example, 0.2 V. Accordingly, by incrementing the gate voltage input to the transistor, the value of the $R_{ON}$ of the transistor may be reduced, thereby compensating for the shift in the $R_{ON}$ of the transistor. The incremented value of the gate voltage input to the transistor is compared with the maximum value of the gate voltage input to determine the end of life of the printhead, at 510. When it is determined that the incremented value of the gate voltage input to the transistor is less than the maximum value of the gate voltage input, the printhead page count is again determined at 504. However, when it is determined at 510 that the incremented value of the gate voltage input to the transistor is greater than or equal to the maximum value of the gate voltage input, the end of life of the printhead may be implied. Thereafter, the method terminates at 512.

With reference to FIG. 5B, a method for compensating the shift in the $R_{ON}$ of the transistor of the printhead based on the printhead page count, in accordance with still another embodiment of the present disclosure is illustrated. The method is initiated at 602. At 604, a value of printhead page count may be determined, which may be stored in at least one of the printhead chip memory and the printer memory. At 606, it is determined whether the value of the printhead page count determined at 604 is less than a predetermined value of the printhead page count. The predetermined value of the printhead page count may be stored in at least one of the printhead chip memory and the printer memory. When it is determined at 606 that the determined value of the print head page count is less than the predetermined value of the printhead page count, the value of the printhead page count is again determined at 604. However, when it is determined at 606 that the determined value of the printhead page count is greater than or equal to the predetermined value of the printhead page count, the determined value of the printhead page count is compared with a maximum value of the printhead page count at 608.

When it is determined at 608 that the determined value of the printhead page count is less than the maximum value of the printhead page count, a gate voltage input to the transistor in the printhead chip is incremented by a predetermined value at 610. Accordingly, by incrementing the gate voltage input to the transistor, the value of the $R_{ON}$ of the transistor may be reduced for compensating the shift in the $R_{ON}$ of the transistor. Thereafter, the incremented value of the gate voltage input to the transistor is compared with the maximum value of the gate voltage input to determine the end of life of the printhead, at 612. When it is determined that the incremented value of the gate voltage input to the transistor is less than the maximum value of the gate voltage input, the printhead page count is determined again at 604. Accordingly, the method is repeated over the life of the printhead until the incremented gate voltage input is determined to be less than the maximum value of the gate voltage input. However, when it is determined at 612 that the incremented value of the gate voltage input to the transistor is greater than or equal to the maximum value of the gate voltage input, the end of life of the printhead is implied. Thereafter, the method terminates at 614.

When it is determined at 608 that the determined value of the printhead page count is greater than or equal to the maximum value of the printhead page count, the end of life of the printhead is implied. Thereafter, the method terminates at 614.

Figure 6A:
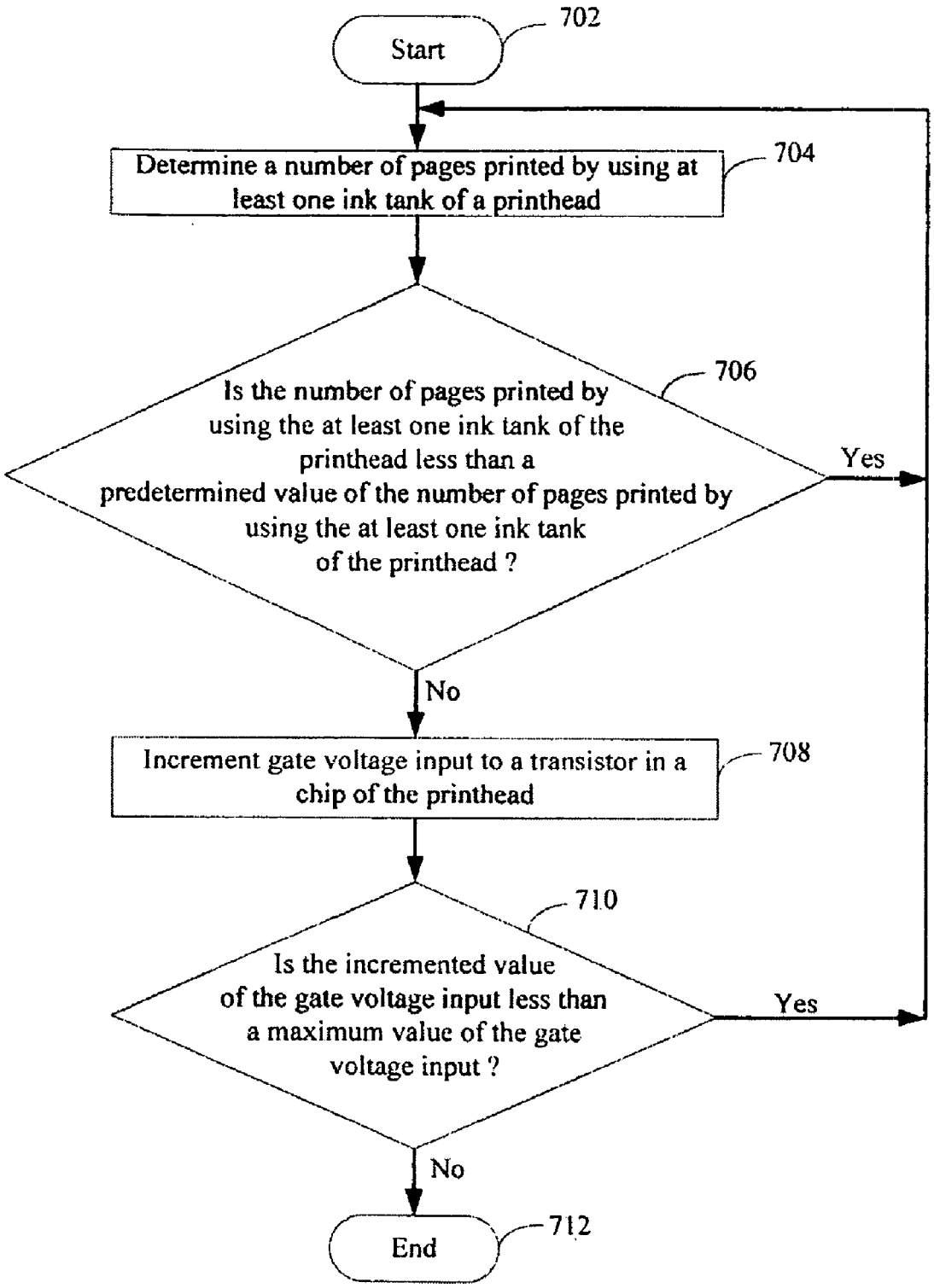
FIG. 6A illustrates a flow diagram representing a method for compensating a shift in ON resistance of a transistor in a printhead chip of an inkjet printer, in accordance with still another exemplary embodiment of the present disclosure.
Figure 6B:
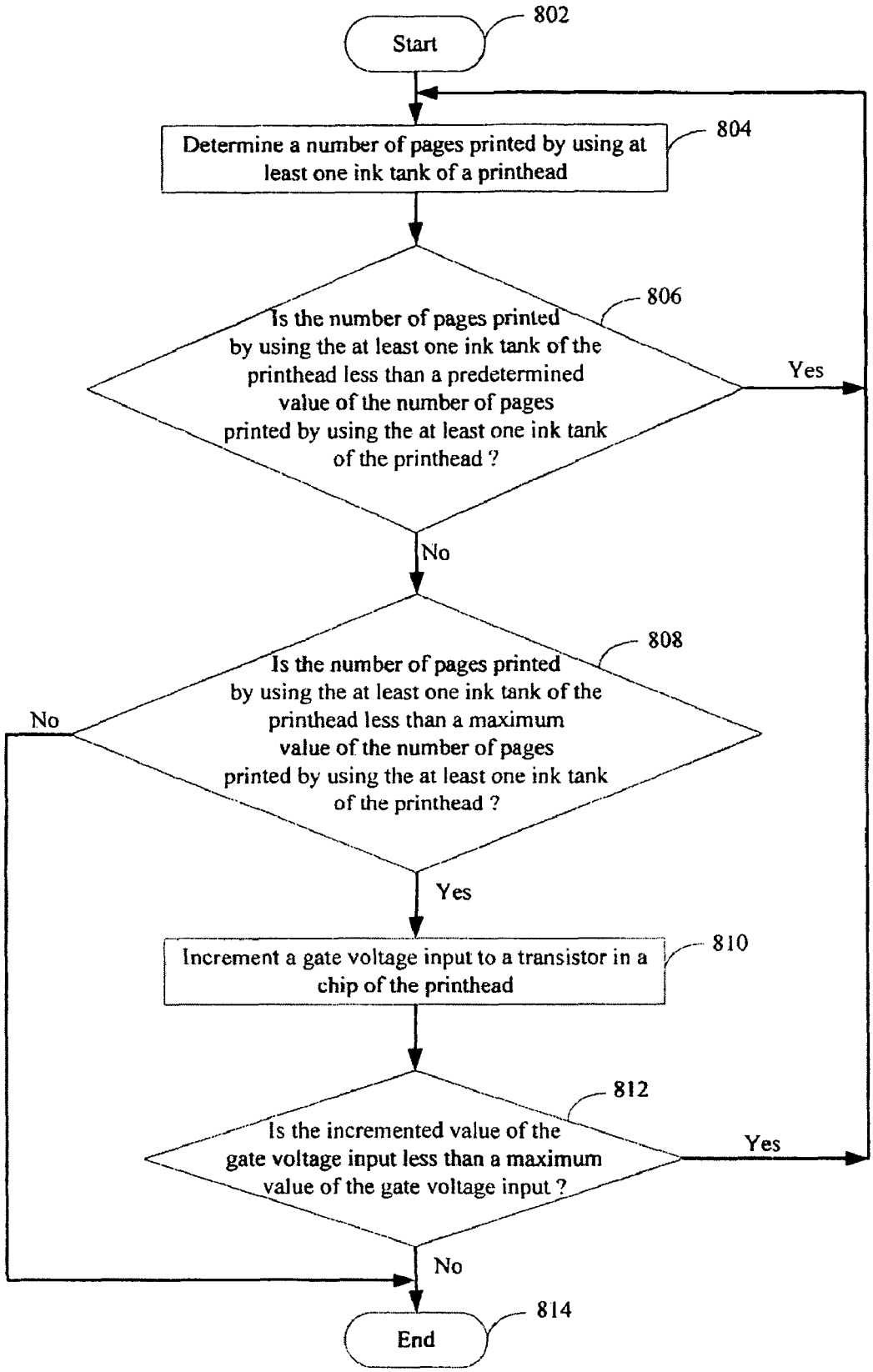
FIG. 6B illustrates a flow diagram representing a method for compensating a shift in ON resistance of a transistor in a printhead chip of an inkjet printer, in accordance with still another exemplary embodiment of the present disclosure.

With reference to FIGS. 6A and 6B, flow diagrams each depicting a method for compensating a shift in $R_{ON}$ of a transistor in a printhead chip of an inkjet printer are illustrated, in accordance with still another embodiment of the present disclosure. In the present embodiments, the shift in the $R_{ON}$ of the transistor is compensated by utilizing information of the number of pages printed by using at least one ink tank that is operatively coupled to the printhead. More specifically, the number of pages printed by using the at least one ink tank (hereinafter referred to as "ink tank page count") represents the life indication parameter. Further, it will be evident to a person skilled in the art that when a plurality of ink tanks are operatively coupled to the printhead, the ink tank page count may individually be obtained for the plurality of ink tanks. However, for the purpose of this description, the method will be explained with respect to the ink tank page count of a single ink tank only.

Moreover, the present embodiments of the present disclosure contemplate compensation of the shift in the $R_{ON}$ of the transistor by incrementing the gate voltage input to the transistor. The gate voltage input is incremented multiple times over the life of the printhead until the end of life of the printhead is reached. More particularly, FIG. 6A depicts determination of the end of life of the printhead based upon comparison of the incremented value of gate voltage input to the transistor with the maximum value of the gate voltage input to the transistor. Further, FIG. 6B depicts determination of the end of life of the printhead based upon comparison of the determined value of the ink tank page count, with a maximum value of the ink tank page count.

As shown in FIG. 6A, the method for compensating the shift in the $R_{ON}$ of the transistor in the printhead chip based on the ink tank page count initiates at 702. A value of the ink tank page count is determined at 704. The value of the ink tank page count may be stored in at least one of the printhead chip memory and the printer memory. At 706, it is determined whether the determined value of the ink tank page count is less than a predetermined value of the ink tank page count. In an embodiment of the present disclosure, the predetermined value of the ink tank page count may include a plurality of values. Accordingly, the determined value of ink tank page count may be compared with any one value of the plurality of values of the ink tank page count depending upon a desired performance of the printhead. However, for the purpose of this description, the method will be explained with respect to one predetermined value of the ink tank page count only.

When it is determined at 706 that the determined value of the ink tank page count is less than the predetermined value of the ink tank page count, the value of the ink tank page count is again determined at 704. However, when it is determined at 706 that the determined value of the ink tank page count is not less than the predetermined value of the ink tank page count, a gate voltage input to the transistor of the printhead may be incremented by a predetermined value at 708. Accordingly, by incrementing the gate voltage input to the transistor, the value of the $R_{ON}$ of the transistor may be reduced, thereby compensating for the shift in the $R_{ON}$ of the transistor in the printhead chip. The incremented value of the gate voltage input to the transistor is compared with the maximum value of the gate voltage input to determine the end of life of the printhead, at 710. When it is determined that the incremented value of the gate voltage input to the transistor is less than the maximum value of the gate voltage input, the ink tank page count is determined again at 704. However, when it is determined that the incremented value of the gate voltage input to the transistor is greater than or equal to the maximum value of the gate voltage input, the end of life of the printhead is implied. Thereafter, the method terminates at 712.

FIG. 6B illustrates a method for compensating the shift in the $R_{ON}$ of the transistor of the printhead based on the ink tank page count, in accordance with still another embodiment of the present disclosure. The method initiates at 802. At 804, a value of the ink tank page count is determined. The value of the ink tank page count may be stored in at least one of the printhead chip memory and the printer memory. At 806, it is determined whether the determined value of the ink tank page count is less than a predetermined value of the ink tank page count. Upon determining the determined value of the ink tank page count to be less than the predetermined value of the ink tank page count at 806, the value of the ink tank page count is again determined at 804. However, when it is determined at 806 that the determined value of the ink tank page count is not less than the predetermined value of the ink tank page count, the determined value of the ink tank page count is compared with a maximum value of the ink tank page count at 808.

When it is determined at 808 that the determined value of the ink tank page count is less than the maximum value of the ink tank page count, a gate voltage input to the transistor of the printhead may be incremented by a predetermined value at 810. Accordingly, by incrementing the gate voltage input to the transistor, the value of the $R_{ON}$ of the transistor may be reduced, thereby compensating for the shift in the $R_{ON}$ of the transistor in the printhead chip. Further, the incremented value of the gate voltage input to the transistor is compared with the maximum value of the gate voltage input at 812. When it is determined that the incremented value of the gate voltage input to the transistor is less than the maximum value of the gate voltage input, the ink tank page count is determined again at 804. The method may be repeated until it is determined that the incremented value of the gate voltage input to the transistor is less than the maximum value of the gate voltage input. However, when it is determined at 812 that the incremented value of the gate voltage input to the transistor is greater than or equal to the maximum value of the gate voltage input, the end of life of the printhead may be implied. Thereafter, the method terminates at 814.

When it is determined that the determined value of the ink tank page count is greater than or equal to the maximum value of the ink tank page count at 808, the method terminates at 814.

Figure 7A:
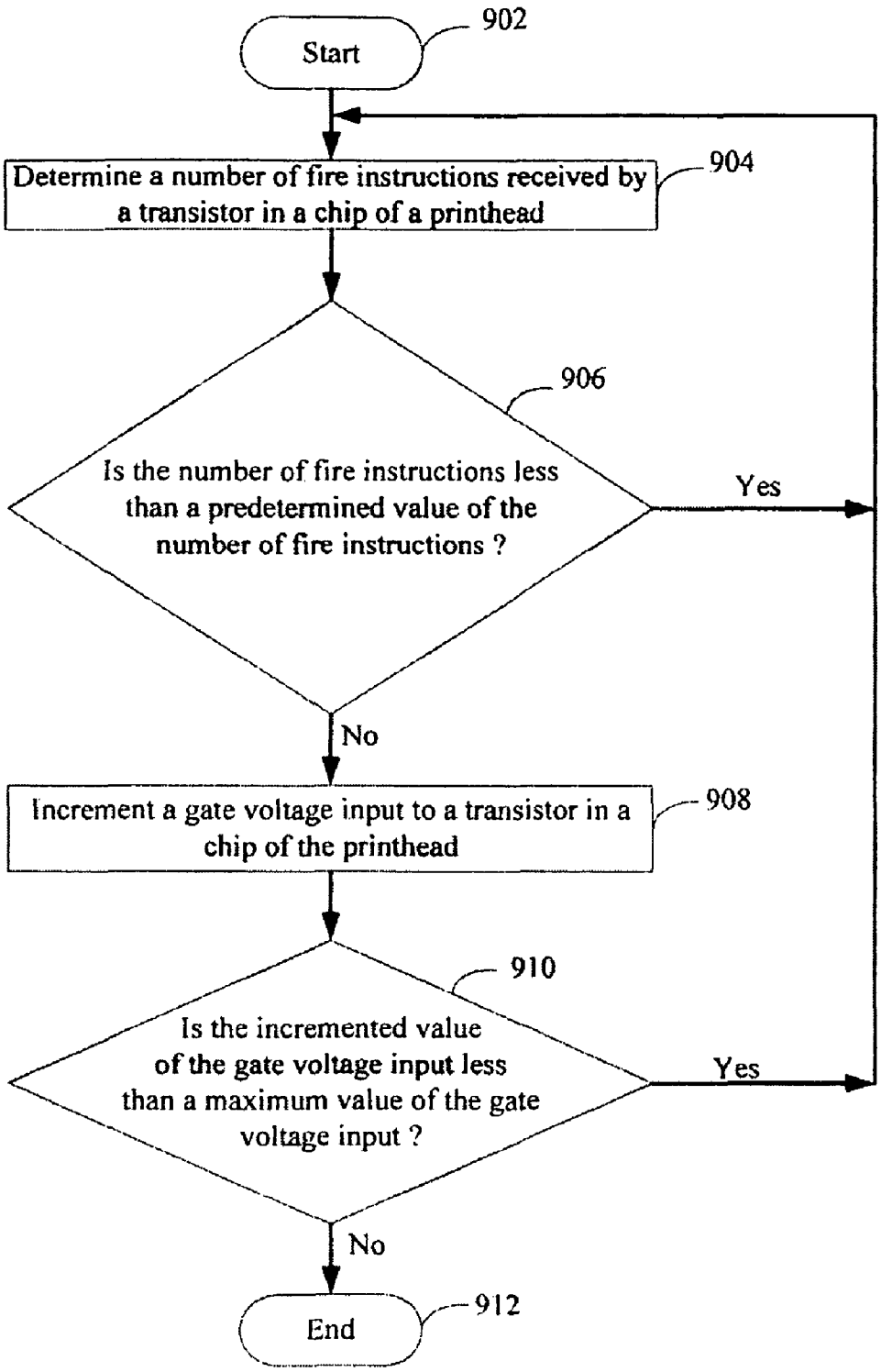
FIG. 7A illustrates a flow diagram representing a method for compensating a shift in ON resistance of a transistor in a printhead chip of an inkjet printer, in accordance with still another exemplary embodiment of the present disclosure.
Figure 7B:
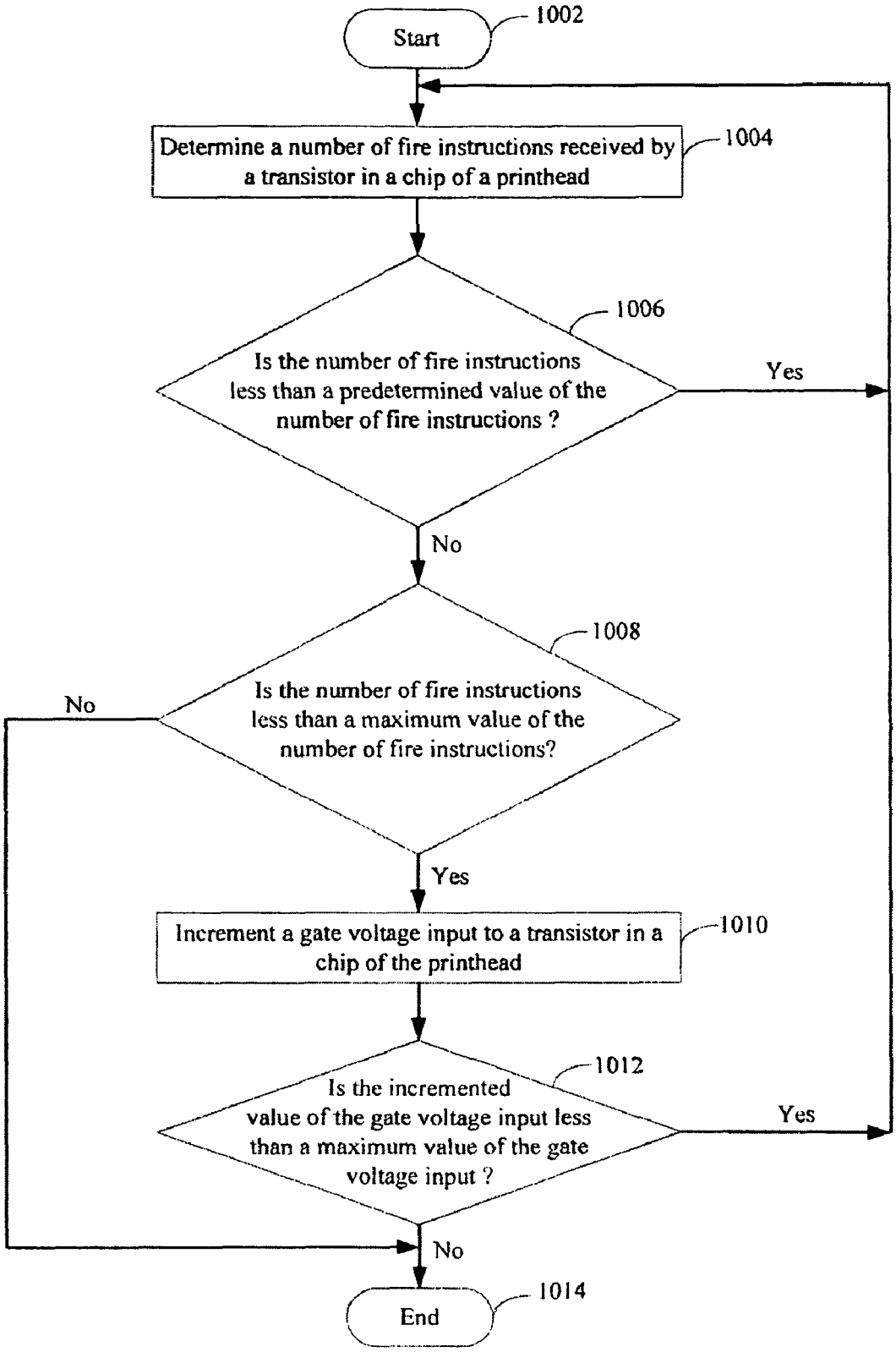
FIG. 7B illustrates a flow diagram representing a method for compensating a shift in ON resistance of a transistor in a printhead chip of an inkjet printer, in accordance with still another exemplary embodiment of the present disclosure.

FIGS. 7A and 7B illustrate methods for compensating a shift in $R_{ON}$ of a transistor of a printhead chip of an inkjet printer, in accordance with still another embodiment of the present disclosure. More specifically, said figures depict methods for compensation of the shift in the $R_{ON}$ of the transistor based upon determination of a number of fire instructions received by the transistor in the printhead chip. Moreover, FIGS. 7A and 7B depict the compensation of the shift in the $R_{ON}$ of transistor by incrementing the gate voltage input to the transistor a multiple number of times over the life of the printhead until the end of life of the printhead is reached. More particularly, FIG. 7A depicts determination of the end of life of the printhead based upon comparison of the incremented value of gate voltage input to the transistor with the maximum value of the gate voltage input to the transistor. Further, FIG. 7B depicts determination of the end of life of the printhead based upon the comparison of the determined value of the number of fire instructions received by the transistor in the printhead chip (hereinafter referred to as 'number of fire instructions'), with a maximum value of the number of fire instructions.

Referring to FIG. 7A, the method for compensating the shift in the $R_{ON}$ of the transistor in the printhead chip based on the number of fire instructions is initiated at 902. A value of the number of fire instructions received by the transistor in the printhead chip is determined at 904. In one embodiment of the present disclosure, the number of fire instructions may be obtained from the printhead page count. More specifically, the printhead page count may be multiplied with an average number of fire instructions per page to obtain the number of fire instructions. The average number of fire instructions per page may be determined based on a best printing density and a printing coverage for the printhead. In another embodiment of the present disclosure, the number of fire instructions may be obtained from the ink tank page count of the at least one ink tank operatively coupled to the printhead. More particularly, the ink tank page count may be multiplied with an average number of fire instructions per page to obtain the number of fire instructions.

At 906, it is determined whether the determined value of the number of fire instructions is less than a predetermined value of the number of fire instructions. In one embodiment of the present disclosure, the predetermined value of the number of fire instructions may be based on a predetermined value of the printhead page count. In another embodiment of the present disclosure, the predetermined value of the number of fire instructions may be based on a predetermined value of the ink tank page count. Further, the predetermined value of the number of fire instructions may be stored in at least one of the printhead chip memory and the printer memory. The predetermined value of the number of fire instructions may include a plurality of values. Accordingly, the determined value of the number of fire instructions may be compared with any one value of the plurality of values of the number of fire instructions depending upon a desired performance of the printhead.

When it is determined at 906 that the determined value of the number of fire instructions is less than the predetermined value of the number of fire instructions, the value of the number of fire instructions received by the transistor is again determined at 904. However, when it is determined at 906 that the determined value of the number of fire instructions is not less than the predetermined value of the number of fire instructions, a gate voltage input to the transistor of the printhead is increased by a predetermined value at 908. Accordingly, by incrementing the gate voltage input to the transistor, the value of $R_{ON}$ of the transistor may be reduced, thereby compensating for the shift in the $R_{ON}$ of the transistor in the printhead chip. The incremented value of the gate voltage input to the transistor is compared with the maximum value of the gate voltage input to determine the end of life of the printhead, at 910. When it is determined that the incremented value of the gate voltage input to the transistor is less than the maximum value of the gate voltage input, the number of fire instructions is determined again at 904. However, when it is determined at 910 that the incremented value of the gate voltage input to the transistor is greater than or equal to the maximum value of the gate voltage input, the end of life of the printhead may be implied. Thereafter, the method terminates at 912.

Referring to FIG. 7B, the method for compensating the shift in the $R_{ON}$ of the transistor in the printhead chip based on the number of fire instructions, in accordance with still another embodiment of the present disclosure is illustrated. The method initiates at 1002. A value of the number of fire instructions received by the transistor in the printhead chip is determined at 1004. As explained in conjunction with FIG. 7A, the number of fire instructions may be determined from a printhead page count or an ink tank page count. Thereafter, at 1006 it is determined whether the value of the number of fire instructions determined at 1004 is less than a predetermined value of the number of fire instructions. The predetermined value of the number of fire instructions may include a plurality of values, and depending upon desired performance of the printhead, the determined value of the number of fire instructions may be compared with any one value of the plurality of values of the number of fire instructions.

Subsequently, when it is determined at 1006 that the determined value of the number of fire instructions is less than the predetermined value of the number of fire instructions, the value of the number of fire instructions received by the transistor is again determined at 1002. However, when it is determined at 1006 that the determined value of the number of fire instructions is not less than the predetermined value of the number of fire instructions, the determined value of the number of fire instructions is compared with a maximum value of the number of fire instructions at 1008. In an embodiment of the present disclosure, the maximum value of the number of fire instructions may be selected based upon a desired performance of the printhead.

When it is determined at 1008 that the determined value of the number of fire instructions is less than the maximum value of the number of fire instructions, a gate voltage input to the transistor of the printhead is incremented by a predetermined value at 1010. Accordingly, by incrementing the gate voltage input to the transistor, the value of $R_{ON}$ of the transistor may be reduced, thereby compensating for the shift in the $R_{ON}$ of the transistor in the printhead chip. The incremented value of the gate voltage input to the transistor is thereafter compared with the maximum value of the gate voltage input to determine the end of life of the printhead, at 1012. Upon determining the incremented value of the gate voltage input to the transistor to be less than the maximum value of the gate voltage input, the number of fire instructions is again determined at 1004. However, when it is determined at 1012 that the incremented value of the gate voltage input to the transistor is greater than or equal to the maximum value of the gate voltage input, the end of life of the printhead is implied. Thereafter, the method terminates at 1014.

When it is determined at 1008 that the determined value of the number of fire instructions is greater than or equal to the maximum value of the number of fire instructions, the method terminates at 1014.

Figure 8:
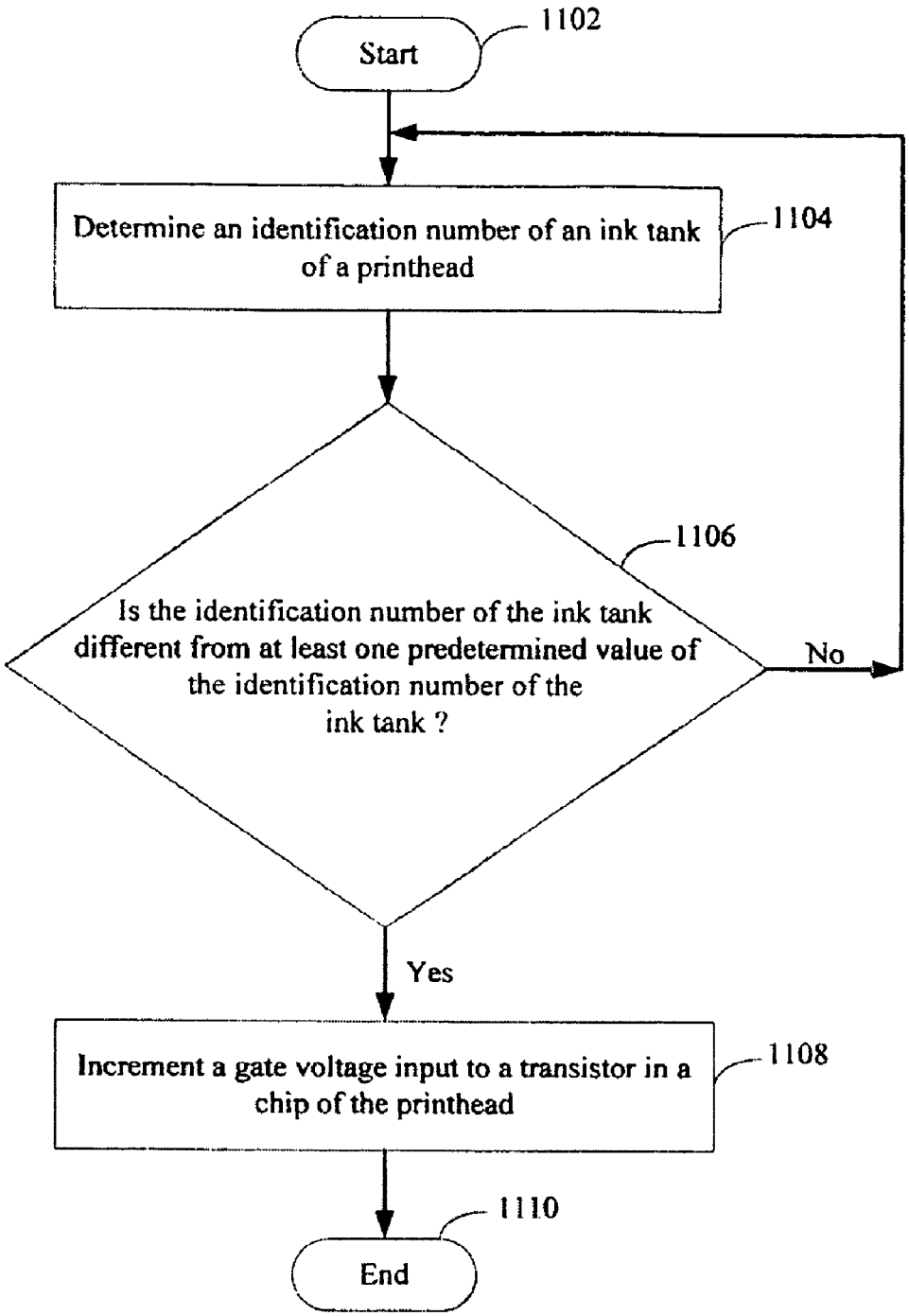
FIG. 8 illustrates a flow diagram representing a method for compensating a shift in ON resistance of a transistor in a printhead chip of an inkjet printer, in accordance with still another exemplary embodiment of the present disclosure.

With reference to FIG. 8, a flow diagram depicting a method for compensating a shift in $R_{ON}$ of a transistor of a printhead chip in an inkjet printer is illustrated, in accordance with still another embodiment of the present disclosure. In the present embodiment, the shift in the $R_{ON}$ of the transistor is compensated by determining a change in at least one ink tank (hereinafter referred to as "ink tank") operatively coupled to the printhead. More specifically, in the present embodiment, an identification number of the ink tank represents the life indication parameter of the printhead.

The method for compensating shift in the $R_{ON}$ of the transistor of the printhead based on the identification number of the ink tank is initiated at 1102. Moreover, the identification number of the ink tank currently being used by the printhead is determined at 1104. It will be obvious to a person skilled in the art that the identification number of the ink tank is unique for each ink tank of the printer. Moreover, the identification numbers corresponding to the ink tanks already utilized by the printhead or currently being utilized by the printhead for printing operations may be stored in at least one of the printer memory and the printhead chip memory. For the present embodiment, the stored identification numbers of all the ink tanks represents at least one predetermined value of the life indication parameter.

At 1106, it is determined whether the identification number of the ink tank is different from the at least one predetermined value of the identification number of the ink tank. The at least one predetermined value of the identification number of the ink tank corresponds to the identification numbers of the ink tanks already utilized or currently being utilized by the printhead. When it is determined at 1106 that the identification number of the ink tank is not different from the at least one predetermined values of the identification number of the ink tank, the identification number of the ink tank may again be determined at 1104. However, when it is determined at 1106 that the identification number of the ink tank is different from each of the at least one predetermined values of the identification numbers, a gate voltage input to the transistor in the printhead chip may be incremented by a predetermined value at 1108.

The predetermined value of the increase in the gate voltage may be based on a desired performance of the printhead. For example, the gate voltage may be increased by 0.2 Volts (V) whenever an existing ink tank is replaced by a new ink tank. In the present embodiment, the gate voltage is increased based on determination of change of a single ink tank of the printer. However, it will be apparent to a person skilled in the art that when the printhead is operatively coupled to a plurality of ink tanks, the gate voltage may be increased in a whole number or as a fraction of the whole number upon a replacement of the single ink tank or multiple ink tanks of the plurality of ink tanks. For example, for a printhead operatively coupled to four ink tanks, the gate voltage may be increased by a value of 0.2 V after all the ink tanks of the printhead have been replaced by new ink tanks. Alternatively, the gate voltage may be increased by 0.05 V after a replacement of each of the ink tanks of the printhead. Accordingly, the shift in the $R_{ON}$ of the transistor in the printhead chip may be compensated. Thereafter, the method terminates at 1110.

Figure 9:
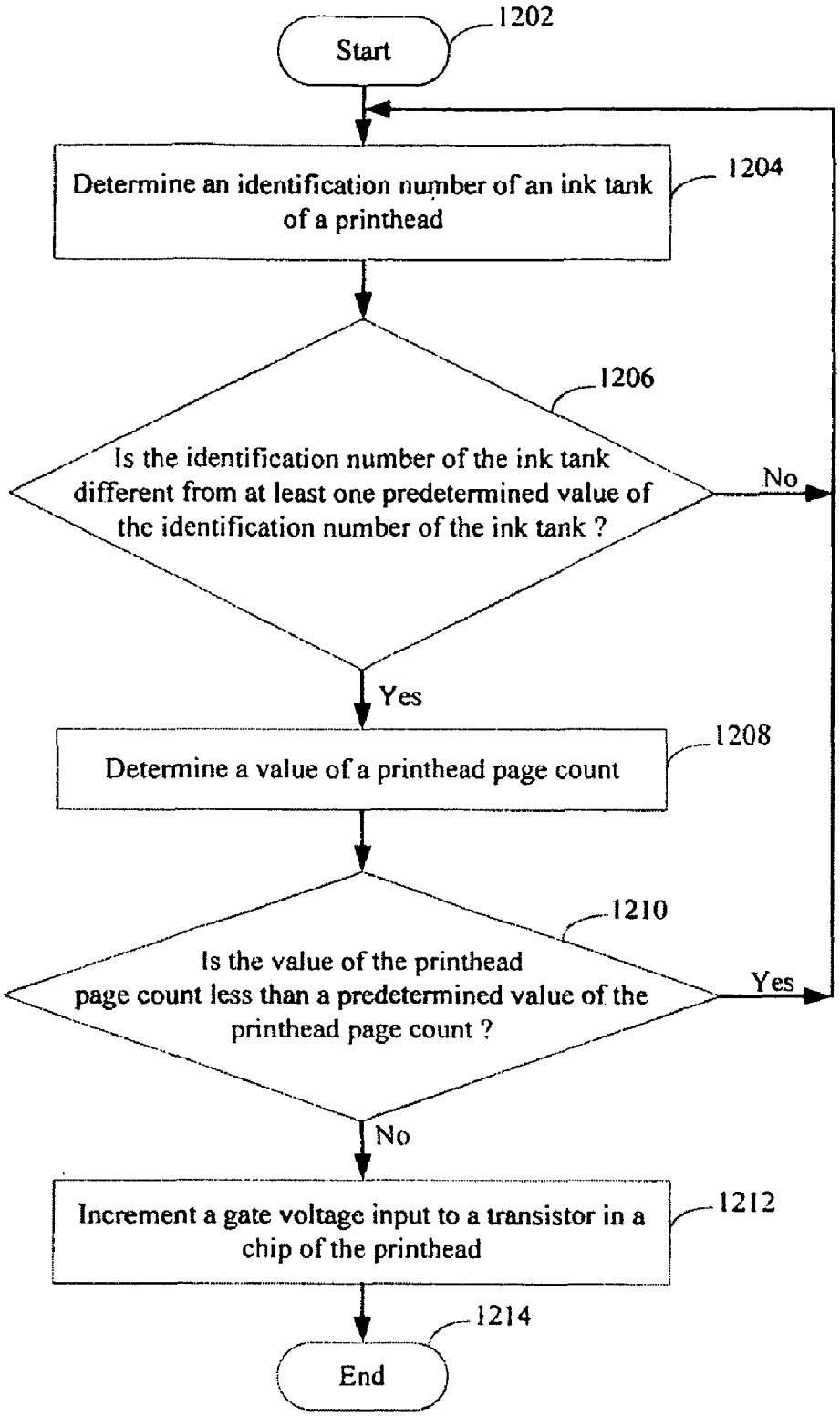
FIG. 9 illustrates a flow diagram representing a method for compensating a shift in ON resistance of a transistor in a printhead chip of an inkjet printer, in accordance with still another exemplary embodiment of the present disclosure.

With reference to FIG. 9, a flow diagram depicting a method for compensating a shift in $R_{ON}$ of a transistor of a printhead chip of an inkjet printer is illustrated, in accordance with still another embodiment of the present disclosure. In the present embodiment, the shift in the $R_{ON}$ of the transistor is based on determination of a change in at least one ink tank (hereinafter referred to as "ink tank") operatively coupled to the printhead, and a printhead page count.

The method for compensating the shift in the $R_{ON}$ of the transistor according to the present embodiment, initiates at 1202. At 1204, an identification number of an ink tank currently being used by the printhead is determined. At 1206, it is determined whether the identification number of the ink tank is different from at least one predetermined value of the identification number of the ink tank. The at least one predetermined value of the identification number of the ink tank corresponds to the identification numbers of the ink tanks already utilized or currently being utilized by the printhead. Further, the at least one predetermined value of the identification number of the printhead may be stored in at least one of the printer memory and the printhead chip memory.

When it is determined at 1206 that the identification number of the ink tank is not different from the at least one predetermined value of the identification number, the identification number of the ink tank is determined again at 1204.

However, when the identification number of the ink tank is determined to be different from the at least one predetermined value of the identification number at 1206, a printhead page count is determined at 1208.

Subsequently, at 1210, it is determined whether the printhead page count is less than a predetermined value of the printhead page count. In an embodiment of the present disclosure, the predetermined value of the printhead page count may include a plurality of values. Accordingly, the determined value of printhead page count may be compared with any one value of the plurality of values of the printhead page count for achieving a desired performance of the printhead. The predetermined value of the printhead page count of the printhead may be stored in the at least one of the printer memory and the printhead chip memory.

Thereafter, when it is determined at 1210 that the determined printhead page count is less than the predetermined value of the printhead page count, the identification number of the ink tank is determined again at 1204. However, when it is determined at 1210 that the determined printhead page count is not less than the predetermined value of the printhead page count, a gate voltage of the transistor is increased by a predetermined value at 1212. Accordingly, by incrementing the gate voltage input to the transistor, the value of the $R_{ON}$ of the transistor may be reduced, thereby compensating for the shift in the $R_{ON}$ of the transistor. The gate voltage input to the transistor may be incremented a multiple number of times over the life of the printhead until the end of life of the print head is reached. The end of life of the printhead may be determined based on the value of printhead page count or the gate voltage input. The determination of end of life of the printhead based on the value of printhead page count and the gate voltage input may be explained further in conjunction with FIGS. 9A and 9B respectively. Upon determining the end of life of the printhead, the method terminates at 1214.

Figure 9A:
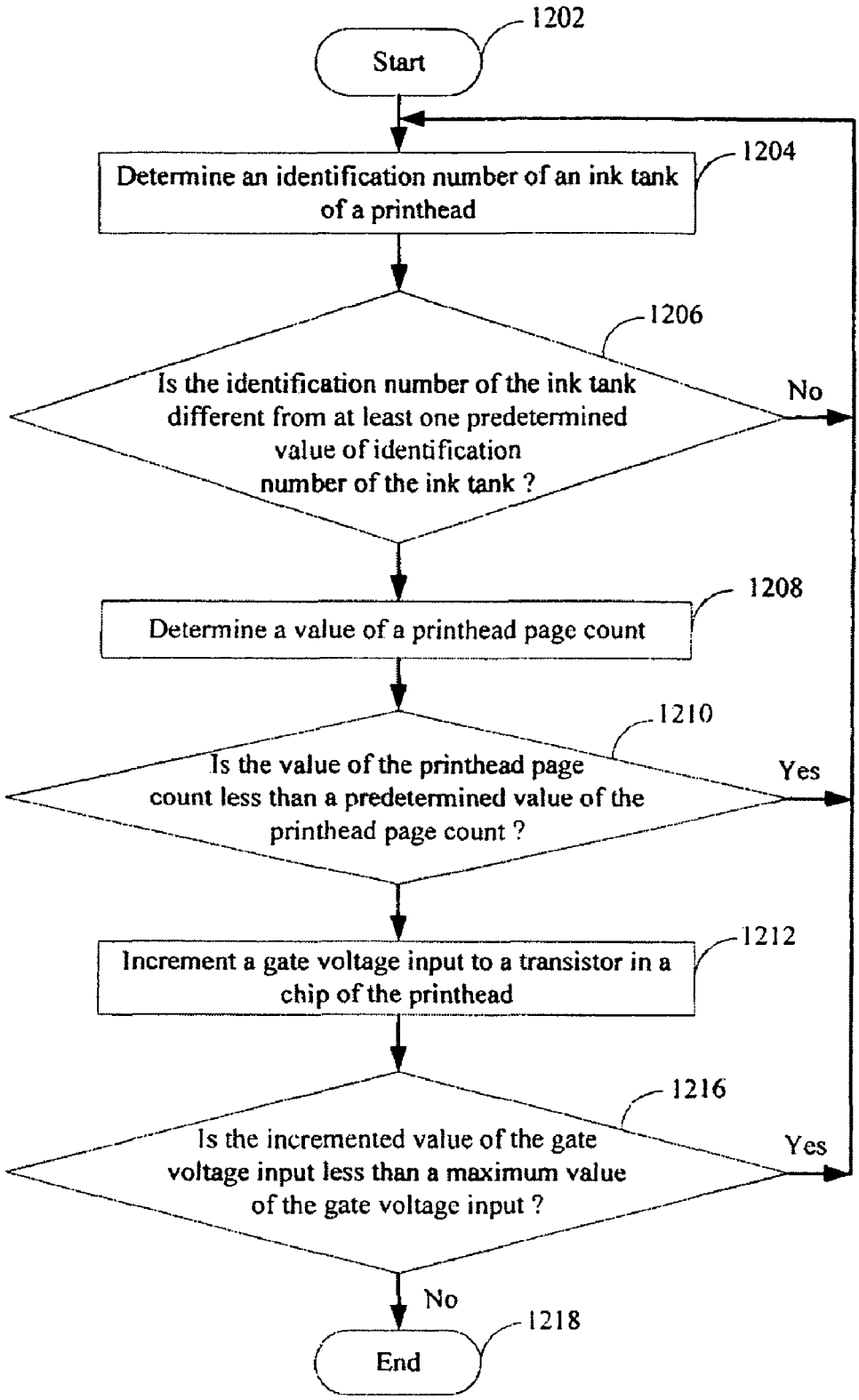
FIG. 9A illustrates a flow diagram representing a method for compensating a shift in ON resistance of a transistor in a printhead chip of an inkjet printer, in accordance with still another exemplary embodiment of the present disclosure.

With reference to FIG. 9A, a flow diagram representing a method for compensating a shift in ON resistance of a transistor in a printhead chip of an inkjet printer, in accordance with still another exemplary embodiment of the present disclosure is illustrated. More specifically, the method explained with reference to flow diagram of FIG. 9A is same as flow diagram illustrated in FIG. 9, except that FIG. 9A includes an additional steps for determination of end of life of the printhead.

In the present embodiment for determination of the end of life of the printhead, the incremented gate voltage input at 1212 may be compared with the maximum gate voltage input at 1216. When it is determined at 1216 that the incremented gate voltage input is less than the maximum gate voltage input, the identification number of the ink tank currently being used by the printhead is determined again at 1204. However, when it is determined at 1216 that the incremented gate voltage input is greater than or equal to the maximum gate voltage input, the end of life span of the printhead is implied. Thereafter, the method terminates at 1218.

Figure 9B:
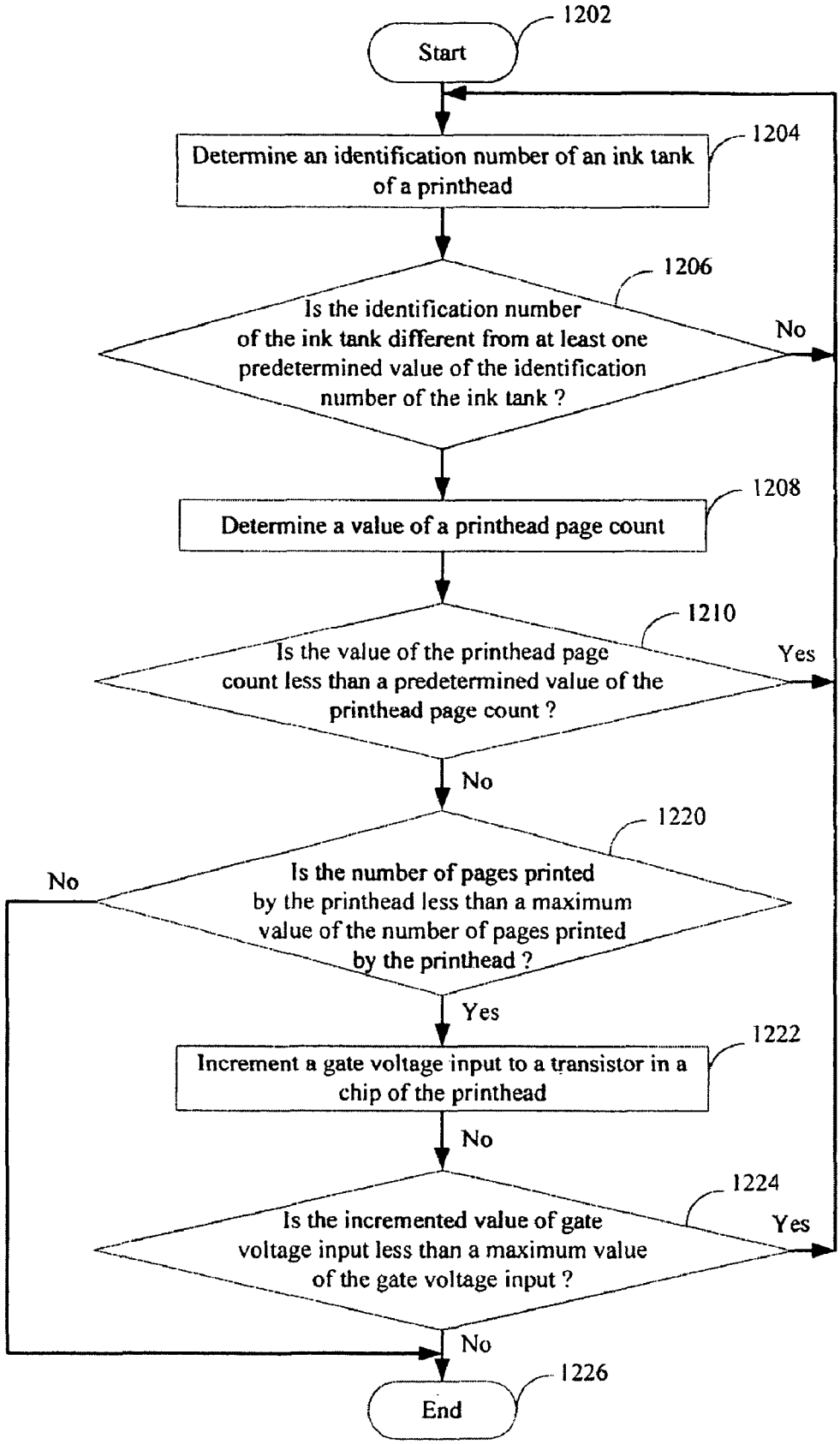
FIG. 9B illustrates a flow diagram representing a method for compensating a shift in ON resistance of a transistor in a printhead chip of an inkjet printer, in accordance with still another exemplary embodiment of the present disclosure.

With reference to FIG. 9B, a flow diagram representing a method for compensating a shift in ON resistance of a transistor in a printhead chip of an inkjet printer, in accordance with still another exemplary embodiment of the present disclosure is illustrated. More specifically, the method explained with reference to flow diagram of FIG. 9B is same as flow diagram illustrated in FIG. 9, except that FIG. 9B includes additional steps for determination of end of life of the printhead. More specifically, steps 1202, 1204, 1206, 1208 and 1210 of FIG. 9B are same as the steps 1202, 1204, 1206, 1208 and 1210 of FIG. 9, and accordingly explanation thereof will be omitted.

Referring to FIG. 9B, the end of life of the printhead is determined by comparing the value of the printhead page count, determined at 1208, with a maximum value of the printhead page count at 1220. When it is determined that that the determined value of the printhead page count is less than the maximum value of the printhead page count, the gate voltage input is increased at 1222. The incremented gate input voltage, at 1222, is compared with the maximum value of the gate voltage input at 1224. When it is determined at 1224 that the incremented value of the gate voltage input is less than the maximum value of the gate voltage input, the identification number of the ink tank currently being used by the printhead is determined again at 1204. However, when it is determined at 1224 that the incremented value of the gate voltage input is greater than or equal to the maximum value of the gate voltage input, the end of life of the printhead is implied. Thereafter, the method terminates at 1226.

When it is determined at 1220 that that the determined value of the printhead page count is greater than or equal to the maximum value of the printhead page count, the method terminates at 1226.

The methods defined in said embodiments may be utilized when at least one ink tank of the printer is replaced. For example, for the purpose of repairing, an ink tank capable of printing 500 pages may be replaced by a new ink tank after printing 100 pages. Upon encountering a unique identification number of the new ink tank, the gate voltage of the transistor of the printhead chip may be increased, which may not be desired. Accordingly, the present embodiment may be utilized for accurately compensating the shift in $R_{ON}$ of the transistors of the printhead.

Figure 10:
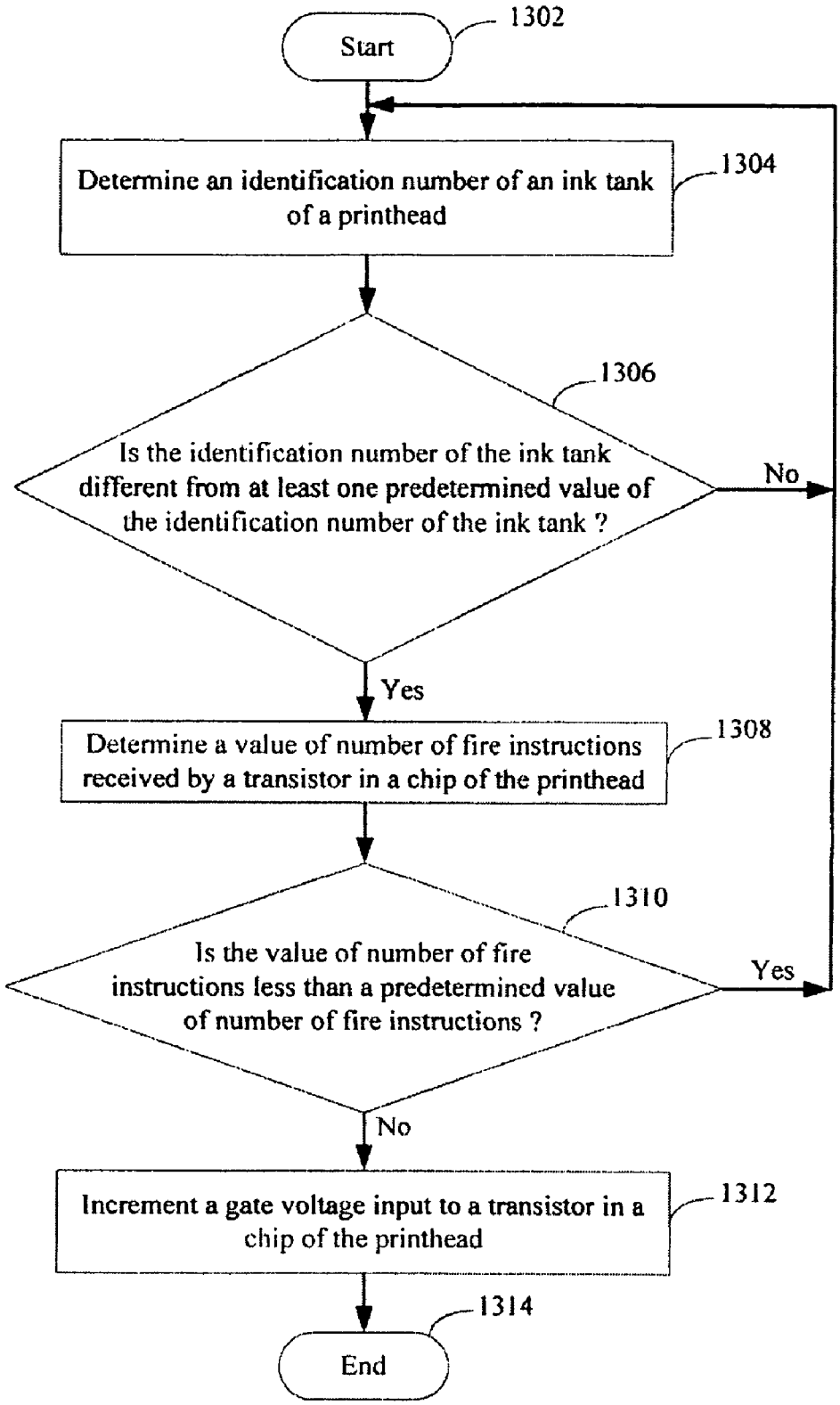
FIG. 10 illustrates a flow diagram representing a method for compensating a shift in ON resistance of a transistor in a printhead chip of an inkjet printer, in accordance with still another exemplary embodiment of the present disclosure.

FIG. 10 illustrates a flow diagram depicting a method for compensating a shift in $R_{ON}$ of a transistor of a printhead chip of an inkjet printer, in accordance with still another embodiment of the present disclosure. In the present embodiment, the shift in the $R_{ON}$ of the transistor is based on determination of a change in at least one ink tank (hereinafter referred to as "ink tank.") operatively coupled to the printhead, and a value of number of fire instructions.

As shown in FIG. 10, the method for compensating the shift in the $R_{ON}$ of the transistor, according to the present embodiment, initiates at 1302. At 1304, an identification number of an ink tank currently being used by the printhead is determined. At 1306, it is determined whether the identification number of the ink tank is different from at least one predetermined value of the identification number of the ink tank. As described in conjunction with FIGS. 8 and 9, the at least one predetermined value of the identification number of the ink tank corresponds to the identification numbers of the ink tanks already utilized or currently being utilized by the printhead. Further, the at least one predetermined value of the identification number of the printhead may be stored in at least one of the printer memory and the printhead chip memory.

Furthermore, when it is determined at 1306 that the identification number of the ink tank is same as the at least one predetermined value of the identification number stored in at least one of the printer memory and the printhead chip memory, the identification number of the ink tank is determined again at 1304. In one embodiment of the present disclosure, the determination of the identification number of the ink tank may be carried out at intervals, for example, after a predetermined time interval during the life of the printhead. Further, when the identification number of the ink tank is determined to be different from the at least one predetermined value of the identification number at 1306, a value of number of fire instructions received by a transistor in a chip of the printhead is determined at 1308. Without limiting the scope of the present disclosure, the value of the number of fire instructions may be determined from a printhead page count or an ink tank page count. More specifically, the printhead page count or the ink tank page count may be multiplied with an average number of fire instructions per page to obtain the number of fire instructions. The average number of fire instructions per page may be determined based on printing density and printing coverage of the print medium. The printing density may be defined as maximum possible dots on the print medium. In an embodiment of the present disclosure, the printing coverage of the print medium may be about 5%.

The value of the number of fire instructions determined at 1308 is compared with at least one predetermined value of the number of fire instructions at 1310. The predetermined value of the number of fire instructions may be stored in the at least one of the printer memory and the printhead chip memory. In an embodiment of the present disclosure, the at least one predetermined value of the number of fire instructions may include a plurality of values. For example, the at least one predetermined value of the number of fire instructions may include values of fire instructions corresponding to the various ink tanks based on capacity of ink tanks or the quality of print on the print medium. Accordingly, for achieving a desired performance of the printhead, the determined value of number of fire instructions may be compared with any one value of the plurality of values of the number of fire instructions.

Upon determining the determined value of the number of fire instructions to be less than the predetermined value of the number of fire instructions at 1310, the identification number of the ink tank is determined again at 1304. However, when at 1310 it is determined that the determined value of number of fire instructions is greater than or equal to the predetermined value of the number of fire instructions, the gate voltage input to the transistor of the printhead chip is incremented by a predetermined value at 1312. Accordingly, by incrementing the gate voltage input to the transistor, the value of the $R_{ON}$ of the transistor may be reduced, thereby compensating for the shift in the $R_{ON}$ of the transistor. The gate voltage input to the transistor may be incremented a multiple number of times over the life of the printhead until the end of life of the print head is reached. The end of life of the printhead may be determined based on the value of number of fire instructions or the gate voltage input. The determination of end of life of the printhead based on the number of fire instructions and the gate voltage input may be explained further in conjunction with FIGS. 10A and 10B respectively. Upon determining the end of life of the printhead, the method terminates at 1314.

Figure 10A:
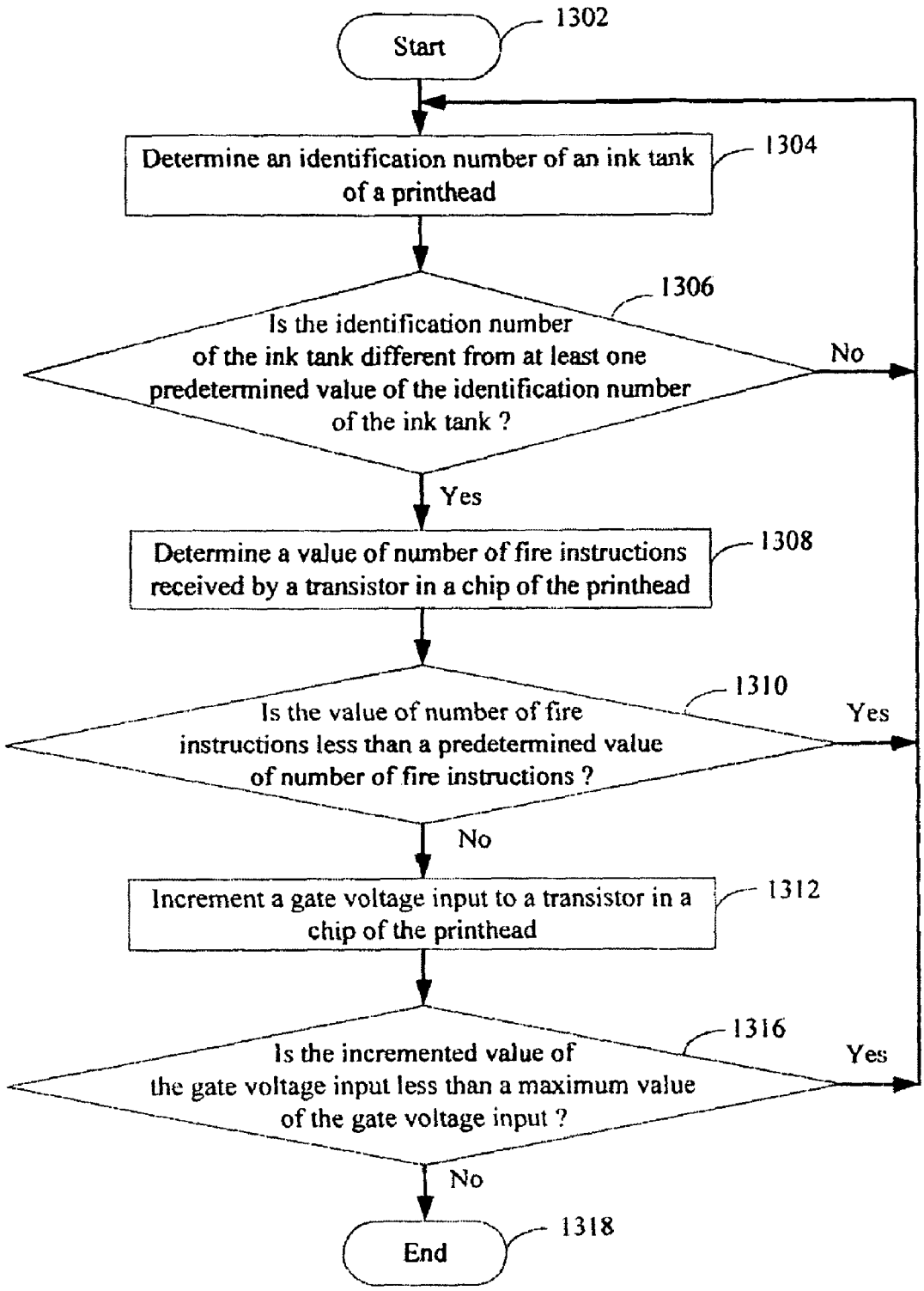
FIG. 10A illustrates a flow diagram representing a method for compensating a shift in ON resistance of a transistor in a printhead chip of an inkjet printer, in accordance with still another exemplary embodiment of the present disclosure.

With reference to FIG. 10A, a flow diagram representing a method for compensating a shift in ON resistance of a transistor in a printhead chip of an inkjet printer, in accordance with still another exemplary embodiment of the present disclosure is illustrated. More specifically, the method explained with reference to flow diagram of FIG. 10A is same as flow diagram illustrated in FIG. 10, except that FIG. 10A includes an additional steps for determination of end of life of the printhead.

In the present embodiment for determination of the end of life of the printhead, the incremented gate voltage input at 1312, may be compared with the maximum gate voltage input at 1316. When it is determined at 1316 that the incremented gate voltage input is less than the maximum gate voltage input, the identification number of the ink tank currently being used by the printhead is determined at 1304. However, when it is determined at 1316 that the incremented gate voltage input is not less than the maximum gate voltage input, the end of life of the printhead is implied. Thereafter, the method terminates at 1318.

Figure 10B:
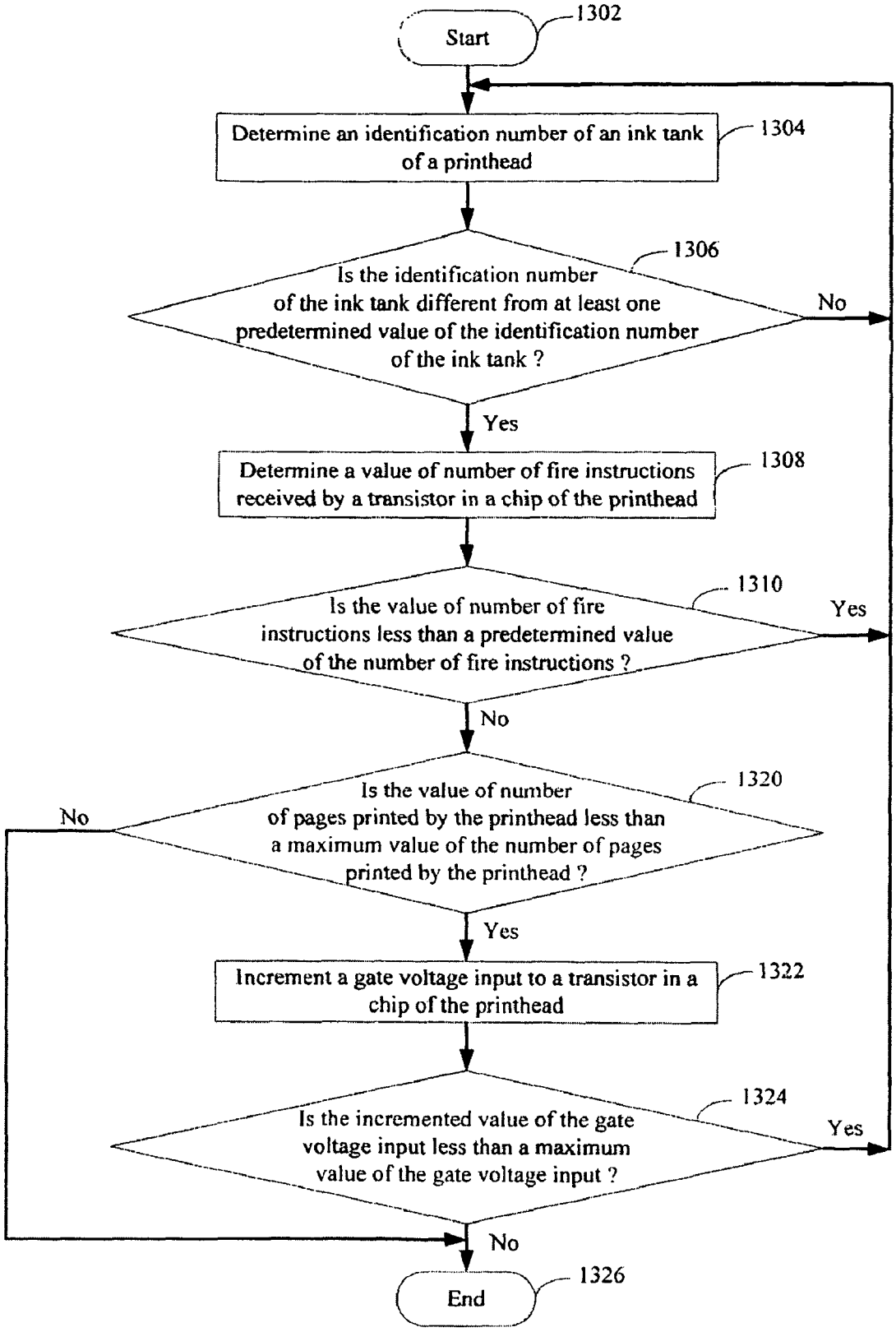
FIG. 10B illustrates a flow diagram representing a method for compensating a shift in ON resistance of a transistor in a printhead chip of an inkjet printer, in accordance with still another exemplary embodiment of the present disclosure.

With reference to FIG. 10B, a flow diagram representing a method for compensating a shift in ON resistance of a transistor in a printhead chip of an inkjet printer, in accordance with still another exemplary embodiment of the present disclosure is illustrated. More specifically, the method explained with reference to flow diagram of FIG. 10B is same as flow diagram illustrated in FIG. 10, except that FIG. 10B includes additional steps for determination of end of life of the printhead. More specifically, steps 1302, 1304, 1306, 1308 and 1310 are same as the steps 1302, 1304, 1306, 1308 and 1310 of FIG. 10, and accordingly the explanation thereof will be omitted.

When at 1310, it is determined that the determined value of number of fire instructions is greater than or equal to the predetermined value of the number of fire instructions, the value of the number of fire instructions determined at 1308 is compared with a maximum value of the printhead page count at 1320.

Upon determining at 1320 that the determined value of the number of fire instructions is less than the maximum value of the number of fire instructions, the gate voltage input is incremented at 1322. Further, the incremented gate input voltage, at 1322, is compared with the maximum value of the gate voltage input at 1324. Upon determining the incremented value of the gate voltage input to be less than the maximum value of the gate voltage input at 1324, the identification number of the ink tank currently being used by the printhead is determined again at 1304. However, when it is determined at 1324 that the incremented value of the gate voltage input is greater than or equal to the maximum value of the gate voltage input, the end of life of the printhead may be implied. Thereafter, the method terminates at 1326.

When it is determined at 1320 that the determined value of the number of fire instructions is greater than or equal to the maximum value of the number of fire instructions, the end of life of the printhead may be implied. Thereafter, the method terminates at 1326.

The various embodiments of the method for compensating the shift in the $R_{ON}$ of the transistor in the printhead chip, as described herein, may be implemented into hardware and/or software of the printhead. In an embodiment of the present disclosure, a control software utilized in the printer may be modified to include the various embodiments of the method described in the present disclosure. Further, the hardware of the printer may be modified to achieve the desired compensation for the shift in the $R_{ON}$ of the transistors in the printhead chip. More specifically, the printhead may include a control circuit operatively coupled to the gate drive circuit of each transistor of the plurality of transistors in the printhead chip. The control circuit may be configured to increase the gate voltage of the each transistor in the printhead chip based upon determination of a life indication parameter and comparison of the life indication parameter with a predetermined value of the life indication parameter, according to various embodiments of the present disclosure. Moreover, the control circuit may be programmed to increase the gate voltage of each of the transistors by a predetermined value depending upon a desired performance of the printhead.

Accordingly, the present disclosure provides various methods that may be utilized for ensuring a good print quality even after a prolonged usage of a printhead over its life span. More specifically, various embodiments of the present disclosure may be advantageously used to compensate the shift in the $R_{ON}$ of transistors in a printhead chip of a printer. Further, depending upon a desired performance of the printer over the life span of the printhead, the gate voltage of the transistors in the printhead chip may be increased by a predetermined value for compensating the shift in the $R_{ON}$ value.

The foregoing description of several methods of the present disclosure has been presented for purposes of illustration. It is not intended to be exhaustive or to limit the disclosure to the precise steps and/or forms disclosed, and obviously many modifications and variations are possible in light of the above teaching. It is intended that the scope of the disclosure be defined by the claims appended hereto.

What is claimed is:

1. A method for compensating a shift in an ON resistance of a transistor in a chip of a printhead of an inkjet printer, the method comprising:

determining a value of a life indication parameter of the printhead, wherein the life indication parameter is a number of pages printed by the printhead;

comparing the determined value of the life indication parameter of the printhead with at least one predetermined value of the life indication parameter of the printhead, wherein the at least one predetermined value of the life indication parameter of the printhead is stored in at least one of a memory of the inkjet printer and a memory of the chip of the printhead; and increasing a voltage level supplied as input to a gate of the transistor as a difference between the determined value of the life indication parameter and the at least one predetermined value of the life indication parameter of the printhead get closer to one another over the life of the printhead, thereby compensating for the shift in the ON resistance of the transistor.

2. A method over a life of a printhead for compensating for an increase in an ON resistance of a transistor in a chip of the printhead of an inkjet printer, the operation of the transistor turning on or not a fluid ejection heater to eject fluid or not from the printhead, the method comprising:

determining an actual number of pages printed by the printhead;

comparing the determined actual number of pages printed to a predetermined number of pages expected to be printed by the printhead during a life of the printhead; and as the determined actual number of pages increases during the life of the printhead, increasing a voltage level of a signal applied to a gate of the transistor to turn on said transistor to cause said fluid ejection heater to said eject fluid, an amount of said increasing the voltage level of the signal applied to the gate of the transistor corresponding to a closeness of the determined actual number of pages printed by the printhead relative to the predetermined number of pages expected to be printed by the printhead, the closer the determined actual number of pages is to the predetermined number of pages a higher the amount of said increasing the voltage level.

* * * * *